US008045912B2

(12) United States Patent
Ushio

(10) Patent No.: US 8,045,912 B2
(45) Date of Patent: Oct. 25, 2011

(54) IMAGE FORMING SYSTEM AND RECORDING MEDIUM FOR STORING PROGRAM

(75) Inventor: Masaru Ushio, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 534 days.

(21) Appl. No.: 11/710,469

(22) Filed: Feb. 26, 2007

(65) Prior Publication Data

US 2007/0274751 A1 Nov. 29, 2007

(30) Foreign Application Priority Data

Mar. 28, 2006 (JP) ..... 2006-088049

(51) Int. Cl.
*G03G 15/00* (2006.01)

(52) U.S. Cl. ..... 399/382; 399/410

(58) Field of Classification Search ..... 399/382, 399/410

See application file for complete search history.

(56) References Cited

U.S. PATENT DOCUMENTS

| | | | | |
|---|---|---|---|---|
| 5,133,048 | A * | 7/1992 | Parsons et al. | 358/1.12 |
| 5,752,154 | A * | 5/1998 | Maruyama et al. | 399/407 |
| 6,393,232 | B1 * | 5/2002 | Osari et al. | 399/82 |
| 6,751,426 | B2 * | 6/2004 | Akiba et al. | 399/82 |
| 6,782,218 | B2 * | 8/2004 | Sekiguchi et al. | 399/81 |
| 7,296,791 | B2 * | 11/2007 | Kurahashi et al. | 271/176 |
| 7,515,295 | B2 * | 4/2009 | Kremer et al. | 358/1.18 |
| 2004/0174552 | A1 | 9/2004 | Miyake et al. | |
| 2005/0123317 | A1 * | 6/2005 | Hayashi | 399/82 |
| 2006/0028690 | A1 * | 2/2006 | Kunori | 358/401 |

FOREIGN PATENT DOCUMENTS

| | | |
|---|---|---|
| JP | 2728812 | 12/1997 |
| JP | 2001-030584 | 2/2001 |
| JP | 2002-3063 | 1/2002 |
| JP | 2005-045479 A | 2/2005 |
| JP | 2005-089112 A | 4/2005 |

OTHER PUBLICATIONS

International Search Report of European Application No. 07250744.5, dated Sep. 10, 2010, 9 pgs.

European Patent Office Communication pursuant to Article 94(3) EPC, issued Aug. 3, 2011, in corresponding European Patent Application 07 250 744.5.

* cited by examiner

*Primary Examiner* — Anthony H. Nguyen

(74) *Attorney, Agent, or Firm* — Finnegan, Henderson, Farabow, Garrett & Dunner, L.L.P.

(57) ABSTRACT

Disclosed herein is an image forming system including: an image forming unit for forming images based on a plurality of document pages on a plurality of recording media to form a printed matter; a special sheet feeding unit for storing a special sheet group constituting one set in which a plurality of different types of special sheets are arranged in a predetermined order; a special sheet setting input unit for accepting the number of the special sheets constituting the one set and a page of which the special sheet is inserted into the plurality of recording media; a division setting input unit for accepting an instruction for dividing the printed matter into a plurality of groups by carrying out a post-processing for the printed matter; and a control unit for setting a special sheet inserted into a first place in each of the plurality of groups to a special sheet arranged at a top of the one set when the special sheet setting input unit accepts the page of which the special sheet is inserted and when the division setting input unit accepts the instruction for dividing the printed matter into the plurality of groups.

11 Claims, 20 Drawing Sheets

FIG. 5

131

JOB DATA

131a

| | | | |
|---|---|---|---|
| PAGE COMMON DATA | | SET PRINT RUN | 1 |
| | | OUTPUTTED PRINT RUN | 0 |
| | | COPY MODE | ONE SURFACE |
| | | POST-PROCESSING MODE | STAPLING AT ONE POSITION |
| | | INTERSHEET | YES |
| | | INSERTION MODE | ONE SURFACE / BLANK PAPER |
| | | SPECIFIED PAGE 1 | 2 |
| | | SPECIFIED PAGE 2 | 4 |
| | | SPECIFIED PAGE 3 | 0 |
| | | ... | ... |
| | | SPECIFIED PAGE m | 0 |
| | | MAIN CONTENTS PAPER FEEDING TRAY | TRAY 1 |
| | | TAB PAPER TRAY | TRAY 2 |
| | | THE NUMBER OF ALREADY-READ IMAGE(S) | 5 |
| | | OUTPUT PAGE | * |
| | | PAPER FEEDING COUNTER | * |
| | | INSERTION POINTER | * |
| | | UNNECESSARY TAB PAPER DISCHARGE FLAG | * |
| | | UNNECESSARY TAB PAPER DISCHARGE COUNTER | * |
| | | TAB PAPER COUNTER | * |

131b

| | | | |
|---|---|---|---|
| INDIVIDUAL PAGE DATA | PAGE 1 | IMAGE STORAGE ADDRESS | 01**** |
| | | STAPLING | YES |
| | | DIVISION | NO |
| | PAGE 2 | IMAGE STORAGE ADDRESS | 02**** |
| | | STAPLING | YES |
| | | DIVISION | NO |
| | ⋮ | ⋮ | ⋮ |
| | PAGE m | IMAGE STORAGE ADDRESS | 0m**** |
| | | STAPLING | YES |
| | | DIVISION | YES |

D1, D2, D3, D4, D5, D6, D7a, D7b, D7c, ⋮, D7m (D7), D8, D9, D10, D11, D12, D13, D14, D15, D16, D21, D22, D23

I1
I2
I3
I4
I5
1
2
3
4
5

P1
P2
P3
P4
P5
INSERTION
INSERTION
Tb1
Tb1
Tb2
Tb3
Tb2
Tb3
DISCHARGE
DISCHARGE

IMAGE FORMING SYSTEM AND RECORDING MEDIUM FOR STORING PROGRAM

BACKGROUND OF THE INVENTION

1. Field of the Invention

The present invention relates to an image forming system and a recording medium for storing a program. In particular, the present invention relates to an image forming system and a recording medium for storing a program using a special sheet group constituting one set having a plurality of different types of special sheets arranged in a predetermined order.

2. Description of the Related Art

Recently, in an image forming system, such as a copying machine, a printer, there is known a technique in which in printing process, special sheets are inserted at set pages to prepare printed matter by using a special sheet group constituting one set in which a plurality of different types of special sheets, such as a plurality of tab paper having different tab positions, a plurality of color sheets having different colors or the like are arranged in a predetermined order. When the special sheet group as described above is used to prepare printed matter, a correct sheet must be inserted to a correct position.

Specifically, in order to prepare printed matter by using special sheet groups, special sheets must be inserted successively in a predetermined order starting with the top sheet of the printed matter on which images were formed. However, when the number of special sheets used for printing one set of printed matter is not an integral multiple of the number of sheets in one set constituting a special sheet group, unnecessary special sheets are remained whenever the printing of one set is completed. An inconvenience that the unnecessary special sheets may be inserted to the next printed matter, is caused unless these unnecessary special sheets are removed from the system.

In order to solve the inconvenience as described above, for example, according to Japanese Patent No. 2728812, the following printing system has been disclosed. According to this system, when the number of special sheets in one set (the number of special sheets included in one set of special sheets) is not an integral multiple of the number of sheets (special sheets) required in one set of printed matter, unnecessary special sheets are removed out of the system.

According to Japanese Unexamined Patent Application No. 2002-3063, the following image forming system is disclosed. In the image forming system, whether an unnecessary tabbed sheet is remained or not is determined based on the number of tabbed sheets to be used (the number of special sheets constituting a special sheet group) and the number of tabbed sheets to be inserted (special sheets). When it is determined that unnecessary tabbed sheets are remained, the selection of a paper discharging tray is prohibited and unnecessary tabbed sheets are discharged to a tray other than a default tray.

An image forming system comprising: an image forming unit for forming an image of a document on a recording medium; and a post-processing unit for carrying out a post-processing, such as a punching processing, a stapling processing, a folding processing or the like, for the recording medium on which an image of a document is formed, is provided.

In the image forming system comprising the post-processing unit as described above, in case that special sheets are inserted into a printed matter having a plurality of pages and the printed matter is divided into a plurality of groups by a post-processing, when a technique for discharging unnecessary special sheets is used for every printed matter, that is for every one set of printed matter, as known in a conventional art, special sheets of consecutive multiple special sheet groups are inserted throughout the entire printed matter. Accordingly, the first special sheet inserted into each group is a special sheet arranged next to the special sheet which is already inserted into the previous special sheet group. As a result, the system is inconvenient. A disadvantageous problem is caused because users must previously divide printed matter into groups in order to arrange the order of special sheets to be inserted to each printed matter group.

SUMMARY

The present invention is achieved in view of the above-described circumstance. An object of the present invention is to provide an image forming system and a recording medium for storing a program in which, in a processing for inserting special sheets into a printed matter divided into a plurality of groups, special sheets are inserted into each group from the top and the order of the special sheets inserted into each group can be correctly arranged.

In order to solve the problem, in accordance with a first aspect of the present invention, an image forming system comprises:

an image forming unit for forming images based on a plurality of document pages on a plurality of recording media to form a printed matter;

a special sheet feeding unit for storing a special sheet group constituting one set in which a plurality of different types of special sheets are arranged in a predetermined order;

a special sheet setting input unit for accepting the number of the special sheets constituting the one set and a page of which the special sheet is inserted into the plurality of recording media;

a division setting input unit for accepting an instruction for dividing the printed matter into a plurality of groups by carrying out a post-processing for the printed matter; and a control unit for setting a special sheet inserted into a first place in each of the plurality of groups to a special sheet arranged at a top of the one set when the special sheet setting input unit accepts the page of which the special sheet is inserted and when the division setting input unit accepts the instruction for dividing the printed matter into the plurality of groups.

Preferably, the control unit discharges an unnecessary special sheet out of the image forming system when the unnecessary special sheet exists, so as to set the special sheet inserted into the first place in each of the plurality of groups to the special sheet arranged at the top of the one set.

Preferably, the control unit discharges a special sheet out of the image forming system as the unnecessary special sheet for each group, the discharged special sheet being included in a same set as a set of special sheets, which includes a special sheet finally inserted into each group.

Preferably, when the number of the unnecessary special sheets is not 0 or is not the number of special sheets constituting the special sheet group, the control unit discharges the unnecessary special sheet out of the image forming system for each group.

Preferably, when the number of the special sheets constituting the one set is "n" and the number of special sheets inserted into the group is "m", the control unit calculates a value X by a following formula (1) as the number of the unnecessary special sheets and discharges X special sheets out of the image forming system.

$$X=n-(\text{remainder of } m/n) \qquad \text{formula (1)}$$

Preferably, the control unit discharges the unnecessary special sheets out of the image forming system after inserting a final special sheet into a first group and before inserting a first special sheet into a second group following the first group.

Preferably, the special sheets constituting the special sheet group are tab paper or color sheets.

Preferably, the instruction for dividing the printed matter into the plurality of groups is an instruction showing a position at which a stapling processing for binding the plurality of recording media on which the images of the plurality of document pages are formed is completed.

Preferably, the image forming system further comprises a post-processing unit for carrying out a post-processing for the printed matter.

In accordance with a second aspect of the invention, a computer-readable recording medium records a program for allowing a computer that controls an image forming system for forming images based on a plurality of document pages on a plurality of recording media to form a printed matter, to execute:

accepting the number of special sheets constituting one set in a special sheet group constituting the one set in which a plurality of different types of special sheets are arranged in a predetermined order, and a page of which the special sheet is inserted into the plurality of recording media;

accepting an instruction for dividing the printed matter into a plurality of groups by carrying out a post-processing for the printed matter; and setting a special sheet inserted into a first place in each of the plurality of groups to a special sheet arranged at a top of the one set when the page of which the special sheet is inserted, is accepted and when the instruction for dividing the printed matter into the plurality of groups, is accepted.

Preferably, an unnecessary special sheet is discharged out of the image forming system when the unnecessary special sheet exists, so as to set the special sheet inserted into the first place in each of the plurality of groups to the special sheet arranged at the top of the one set.

Preferably, a special sheet is discharged out of the image forming system as the unnecessary special sheet for each group, the discharged special sheet being included in a same set as a set of special sheets, which includes a special sheet finally inserted into each group.

Preferably, when the number of the unnecessary special sheets is not 0 or is not the number of special sheets constituting the special sheet group for each group, the control unit discharges the unnecessary special sheet out of the image forming system.

Preferably, when the number of the special sheets constituting the one set is "n" and the number of special sheets inserted into the group is "m", a value X is calculated by a following formula (1) as the number of the unnecessary special sheets and X special sheets are discharged out of the image forming system.

$$X=n-(\text{remainder of } m/n) \qquad \text{formula (1)}$$

Preferably, the unnecessary special sheets are discharged out of the image forming system after inserting a final special sheet into a first group and before inserting a first special sheet into a second group following the first group.

Preferably, the special sheets constituting the special sheet group are tab paper or color sheets.

Preferably, the instruction for dividing the printed matter into the plurality of groups is an instruction showing a position at which a stapling processing for binding the plurality of recording media on which the images of the plurality of document pages are formed is completed.

In accordance with a third aspect of the invention, an image forming system comprises:

an image forming unit for forming images based on a plurality of document pages on a plurality of recording media to form a printed matter;

a special sheet feeding unit for storing a special sheet group constituting one set in which a plurality of different types of special sheets are arranged in a predetermined order;

a special sheet setting input unit for setting the number of the special sheets constituting the one set and a position at which the special sheet is inserted into the plurality of recording media;

a division setting input unit for accepting an instruction for dividing the printed matter into a plurality of groups; and a conveyance control unit for inserting the special sheet at the position set by the special sheet setting input unit, and for discharging an unnecessary special sheet so as to set a special sheet first inserted into each of the plurality of groups divided by the division setting input unit, to a special sheet arranged at a top of the one set.

Preferably, the instruction for dividing the printed matter into a plurality of groups, is an instruction for showing a position at which a stapling processing for binding the plurality of recording media on which the images of the plurality of document pages are formed is completed.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein:

FIG. 5 illustrates an example of job data stored in a job setting information storage region;

DETAILED DESCRIPTION OF THE PREFERRED EMBODIMENT

Hereinafter, embodiments of the present invention will be described in detail with reference to the drawings.

First, the structure will be described.

Figure 1:
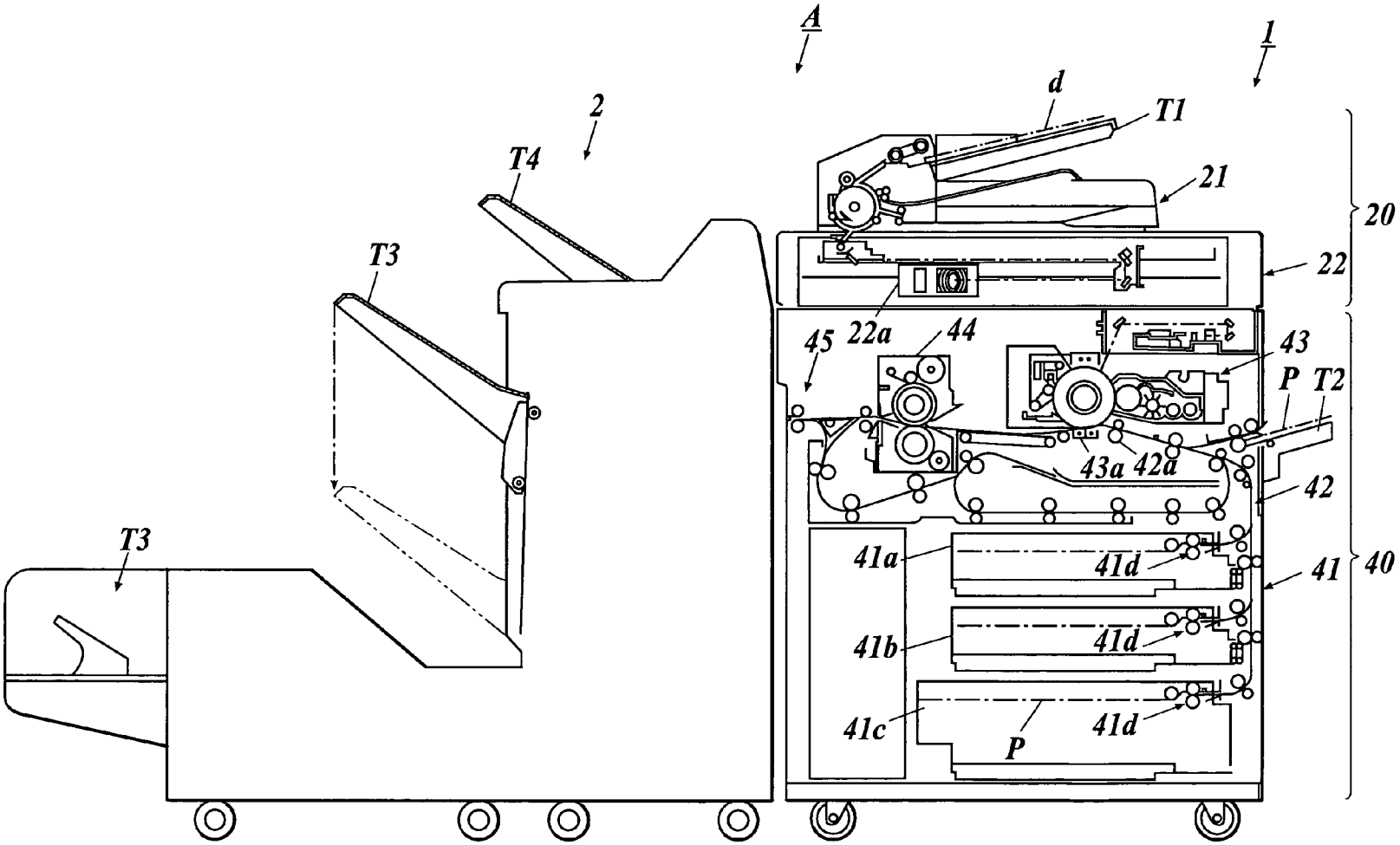
FIG. 1 is a schematic view illustrating the structure of an image forming system A of this embodiment.

FIG. 1 is a schematic view illustrating an image forming system A in this embodiment.

As shown in FIG. 1, the image forming system A comprises: an image forming apparatus 1 for reading an image of a document to form the read image on a recording medium P as paper to be processed, such as paper, and for receiving image data from an external apparatus 3 or the like, which will be described later, to form an image on the recording medium P based on the image data, and a post-processing apparatus (finisher (FNS)) 2 for carrying out a post processing, such as a punching processing, a stapling processing, a folding processing, a cutting processing or the like, for the recording medium P on which the image is formed by the image forming apparatus 1.

The image forming apparatus 1 comprises an image reader 20 and a print unit 40. It is noted that the image forming apparatus 1 to which the present invention can be applied, is not limited to a complex machine and also may be, for example, a copying machine or a printer. In this embodiment, a case that the image forming apparatus 1 is an electrophotographic type of complex machine will be exemplarily described.

The image reader 20 comprises an automatic document feeder (ADF) 21 and a reader 22. The document d which is mounted on a document tray T1 of the automatic document feeder 21, is conveyed to a contact glass which is a reading position of the reader 22. Then, an image on one surface or images on both surfaces of the document d is/are read by an optical system of the reader 22 and the image(s) of the document d is/are read by an image sensor 22*a* using a Charge Coupled Device (CCD) for example. The term "image" herein is not limited to image data, such as graphic form, photograph or the like and also includes text data, such as character, mark or the like.

The image (analog image signal) read by the reader 22 is outputted to a main body controller which will be described later. After the main body controller carries out an A/D conversion for the image and various image processings are carried out for the converted image, the image is outputted to the print unit 40.

Based on the inputted printing data, the print unit 40 performs an electrophotographic type of image forming processing. The print unit 40 comprises a paper feeder 41, a paper conveying unit 42, an image forming unit 43, a fixing unit 44, and a carrying-out unit 45.

The paper feeder 41 comprises a plurality of paper feeding trays 41*a*, 41*b*, and 41*c*; paper feeding units 41*d* provided in each of the paper feeding trays 41*a*, 41*b*, and 41*c*; and a manual paper feed tray T2 and the like. The paper feeding trays 41*a*, 41*b*, and 41*c* are structured so that recording media P which have different types and different sizes, such as plain paper, backside paper, recycled paper, high-quality paper, tab paper or the like and which are previously identified, can be stored in the paper feeding trays according to the types and sizes, respectively. Then, the recording media P are conveyed to the paper conveying unit 42 by conveying the recoding media from the uppermost part of each of the recording media P stored in the paper feeding unit 41*d*, in one-by-one manner. The manual paper feed tray T2 can store various types of recording media P on a case-by-case basis depending on the need by a user. Then, the uppermost part of the stored recording media P is conveyed by a paper feeding roller to the paper conveying unit 42 in one-by-one manner.

It is noted that the number of the paper feeding trays is not limited to the illustrated example herein and also may be smaller or lager than that of the illustrated trays.

The recording medium P in this embodiment may be a main contents recording medium that is a recording medium on which an image based on image data of a document is formed and a special sheet that is appropriately inserted into main recording media.

Special sheets mean a plurality of different types of recording media that are arranged in a predetermined order to constitute a special sheet group constituting one set. Hereinafter, in this embodiment, the tab papers arranged so as to have different tab positions sequentially from that of the first tab page will be exemplarily described.

Tab papers are special sheets stored in one of the paper feeding trays 41*a*, 41*b*, and 41*c* as a special sheet group constituting one set having the predetermined number of sheets, such as three tab papers, five tab papers or the like depending on an application or the like. Hereinafter, the special sheet group also may be referred to as a tab paper group because an example of a special sheet is explained by using a tab paper.

It is noted that special sheets are not limited to tab papers having different tab positions when the special sheets constitutes one set of the special sheet group so as to arrange a plurality of different types of special sheets in a predetermined order. For example, special sheets also may be color sheets which constitute one set of color sheets by arranging a plurality of different color sheets sequentially from the first sheet.

The paper conveying unit 42 conveys the recording medium P conveyed from the paper feeding trays 41*a*, 41*b*, and 41*c* or the manual paper feed tray T2 to a transfer device 43*a* via a plurality of intermediate rollers and a resist roller 42*a* and the like. The paper conveying unit 42 also conveys the recording medium P having one surface on which an image is already formed to an automatic both-side paper feeding conveyance path by using a conveying path switching plate, and conveys the recording medium P to the transfer device 43*a* through the intermediate roller and the resist roller 42*a* again.

The image forming unit 43 comprises a photoconductor drum, a charging device, an exposure device having a laser output unit for outputting laser light based on image data and a polygon mirror for scanning laser light in the main scanning direction, a developing device, a transfer device 43*a*, and a cleaning unit. Specifically, laser light is emitted to the photoconductor drum charged by the charging device to form an electrostatic latent image. Then, the developing device causes charged toner to be attached to the surface of the photoconductor drum on which the electrostatic latent image is formed to develop an electrostatic latent image. The toner image formed on the photoconductor drum by the developing device is transferred by the transfer device 43*a* onto the recording medium P. After the transfer of the toner image on the recording medium P, residual charge, residual toner and the like on the surface of the photoconductor drum is removed by the cleaning unit.

The fixing unit 44 fixes the toner image which is conveyed by the paper conveying unit 42 and which is transferred on the recording medium P, by heat fixing. The recording medium P for which the fixing processing is carried out, is sandwiched by paper discharge rollers of the carrying-out unit 45 and is outputted from a carrying-out opening to the post-processing apparatus 2.

The post-processing apparatus 2 comprises various post-processing units, such as a sort unit for carrying out a sort processing for the recording medium P on which an image is formed, a punching unit for performing a punching processing for providing punched holes, a stapling unit for performing a stapling processing for stapling a bundle of the recording media P, a folding unit for performing a folding processing, a cutting unit for performing a cutting processing and the like; a paper discharging tray T3 for discharging the recording medium P for which various post processings are carried out or are not carried out; and an unnecessary paper discharging tray T4 for discharging an unnecessary tab paper.

It is noted that, although in this embodiment, an example in which a paper feeding tray for storing tab paper is provided at the side of the image forming apparatus 1, is described, a paper feeding tray for storing tab paper also may be provided at the side of the post-processing apparatus 2 when an image is not required to be formed on the tab paper.

Figure 2:
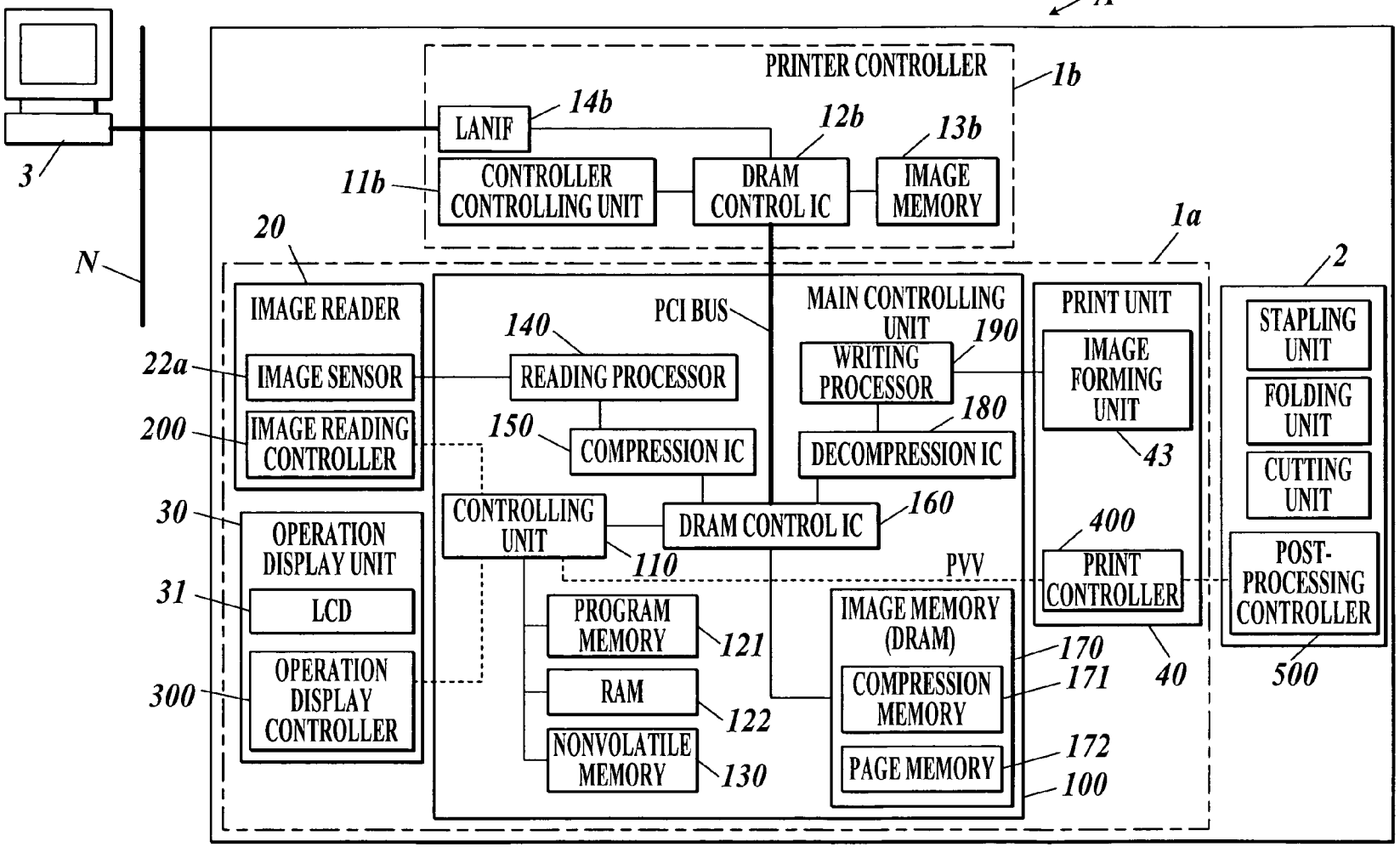
FIG. 2 is a control block diagram for the image forming system A.

FIG. 2 is a control block diagram of an image forming system A.

As shown in FIG. 2, the image forming system A is connected to an external apparatus 3 on a network N via a Local Area Network Inter Face (LANIF) 14*b* of a printer controller 1*b* so that information can be transmitted and received from each other.

The external apparatus 3 is for remotely controlling the image forming system A. For example, when the external apparatus 3 controls the image forming system A to perform a printing processing, the external apparatus 3 converts various setting conditions set at the printing and image data to a data format based on a printer descriptive language or the like that can be processed by the image forming system A and sends the converted data to the image forming system A. The data conversion is performed by using software called as a printer driver. As the external apparatus 3 having the printer driver as described above may be, for example, an information processing apparatus, such as general-purpose PC, is applicable.

The external apparatus 3 comprises a controller, a memory unit, a Random Access Memory (RAM), an operation unit, a display unit, a communication unit and the like. Each unit is connected to the other via a bus so as to be communicable among the units.

The controller of the external apparatus 3 performs various processing, such as an image control processing, by cooperating with an application software program memorized by the memory unit, a printer driver program for performing the printer driver, a print control processing and various pieces of data, to store the processing result in the RAM and displays various setting screens on the display unit including a Liquid Crystal Display (LCD) or the like.

The operation unit comprises a keyboard having numeric keys, character keys, cursor movement keys, various function keys and the like for inputting an operation instruction to the external apparatus 3 and the image forming system A; a pointing device, such as a mouse; and a touch panel provided so as to cover the display screen of the display unit. The operation unit outputs a depression signal generated by the keyboard or the touch panel and an operation signal generated by the mouse as an input signal to the controller.

Figure 3:
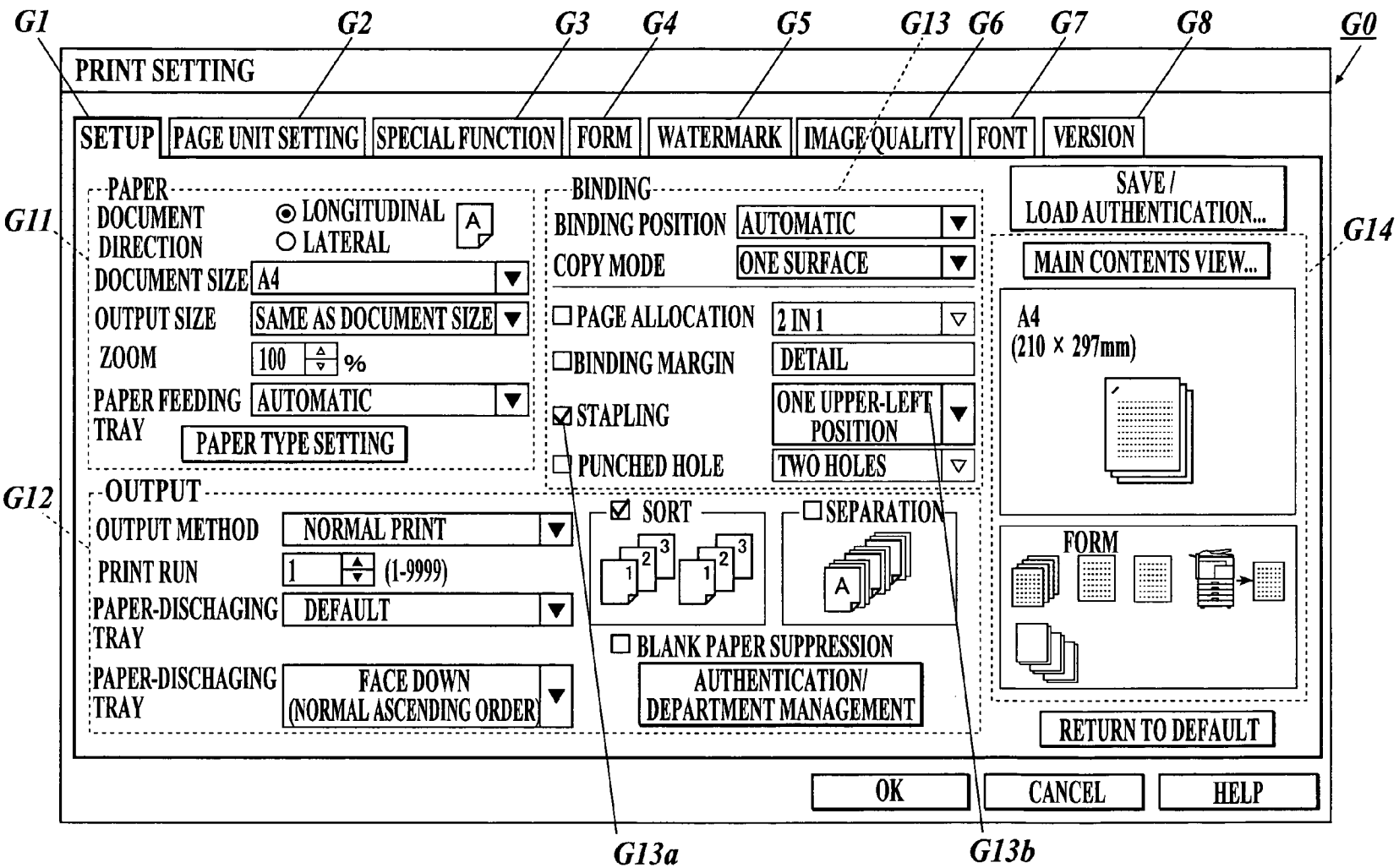
FIG. 3 illustrates an example of a setup screen G0.
Figure 4:
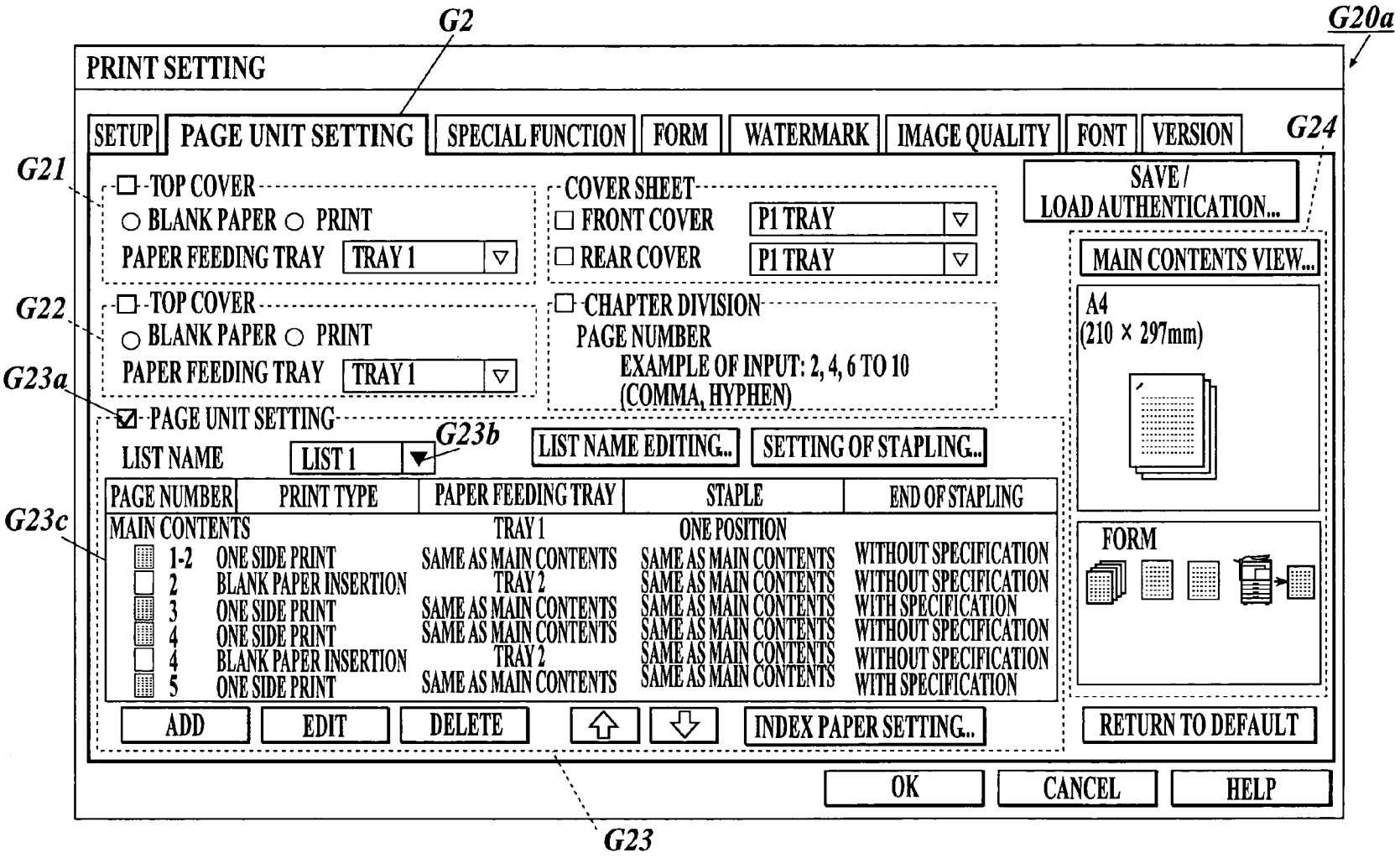
FIG. 4 illustrates an example of a page unit setting screen G20*a;*

FIG. 3 and FIG. 4 illustrate examples of various setting screens displayed on the display screen of the display unit of the external apparatus 3. The various setting screens are the screens for instructing the setting information in the print processing for every job, when the external apparatus 3 causes the image forming system A to perform a print processing by executing the printer driver.

FIG. 3 illustrates an example of a setup screen G0. FIG. 4 illustrates an example of a page unit setting screen G20*a*.

The setup screen G0 shown in FIG. 3 comprises: an setup index G1 including a paper setting area G11, an output setting area G12, a binding setting area G13, and a preview area G14; a page unit setting index G2 for switching to a page unit setting screen; a special function index G3 for switching to a special function setting screen; a form index G4 for switching to a form setting screen; a watermark index G5 for switching to a watermark setting screen; an image quality index G6 for switching to an image quality setting screen; a font index G7 for switching to a font setting screen; a version index G8 for switching to a version check screen displaying a revised edition of a printer driver and the like.

The binding setting area G13 comprises: a binding position setting button for setting a binding position; a copy mode setting button for setting a copy mode; a page allocation check box for setting whether a plurality of documents are allocated to one page or not; an aggregation number setting button for setting the number of documents to be aggregated when the page allocation check box is checked; a binding margin check box for setting whether an binding margin is arbitrarily set or not; a binding margin setting button for displaying a screen for displaying detailed information for the binding margin, such as the width of the binding margin, image position and the like when the binding margin check box is checked; a staple check box G13*a* for setting whether stapling is required or not; a staple setting button G13*b* for setting the type of the staple when the staple check box G13*a* is checked; and the like.

The page unit setting screen G20*a* shown in FIG. 4 displays a page unit setting index G2 including a top cover setting area G21, a back cover setting area G22, a page unit setting area G23, a preview area G24*a* and the like.

The page unit setting area G23 comprises: a page unit setting check box G23*a* for setting whether various setting conditions are set for each document page; a condition selection button G23*b* for setting various setting conditions desired by a user from among a plurality of various predetermined setting conditions when the page unit setting check box G23*a* is checked; an individual page conditions list area G23*c* for displaying individual conditions for each document page when the page unit setting check box G23*a* is checked, and the like.

The individual page conditions list area G23*c* displays individual conditions such as a page number for identifying a document page or a page number at which a tab paper is inserted, the setting of the print type corresponding to this page number, the setting of the paper feeding tray, the setting of the type of a post-processing (in this embodiment, stapling is required or not and a stapling position in case that stapling is required), the setting for specifying whether the set post processing is performed at an end of a document page (division position) or not (end position of the stapling processing in this embodiment), and the like, so that the conditions can be changed.

As shown in FIG. 4, in this embodiment, various conditions are individually set to five document pages. For example, document pages having page numbers of 1, 2, and 4 are set so that an image is formed on one surface of a recording medium (main contents recording medium) stored in the tray 1, and one position of stapling is performed, but an end position of stapling is not specified. A blank page insertion after document pages having page number 2 and 4, that is, the insertion of the recording medium (tab paper) stored in the tray 2, on which an image is not formed, is specified, and one position of this inserted recording medium (tab paper) is stapled but the end position of the stapling is not specified. Furthermore, with regards to the document pages having page number 3 and 5, an image is formed on one surface of a recording medium (main contents recording medium) stored in the tray 1, one position of the recording medium is stapled, and the end position of stapling is specified.

Consequently, two groups of recording media bundle are produced. One is a group of recording media bundle in which tab paper is inserted between main contents recording media on which images of document pages having page number 2 and 3 are formed, and is stapled. The other is a group of recording media bundle in which tab paper is inserted between main contents recording media on which images of document pages having page number 4 and 5 are formed, and is stapled.

In this embodiment, when the page unit setting check box G23*a* is checked and various settings are performed by using the individual page conditions list area G23*c*, the specification of a page into which tab paper is inserted, among a plurality of main recording media is accepted and the function of the special sheet setting input unit and the function of the division setting input unit, in which the instruction for dividing printed matter having a plurality of main recording media into a plurality of groups (booklets), are realized.

The preview area G24 displays a print image of the document page selected in the individual page conditions list area G23*c*.

The network N may be Local Area Network (LAN), WAN (Wide Area Network). The network N also may have a configuration including a telephone line network, Integrated Services Digital Network (ISDN) line network, a broadband communication line network, an exclusive line, a mobile communications network, a communication satellite line, Community Antenna Television (CATV) line, an optical communication line, a radio communication line or the like and the Internet service provider connecting the above network.

The image forming system A comprises: a main body 1*a*; the printer controller 1*b*; and a post-processing apparatus 2 connected to the main body 1*a*.

The main body 1*a* comprises: the image reader 20, the operation display unit 30, the print unit 40, and the main body controller 100. It is noted that the same components as those described with reference to FIG. 1 are denoted with the same reference numerals and will not be described further.

The main body controller 100 is a computer comprising: a controller 110; a program memory 121; a Random Access Memory (RAM) 122; a nonvolatile memory 130; a reading processor 140; a compression IC 150; a Dynamic Random Access Memory (DRAM) control IC 160; an image memory 170; a decompression IC 180; and a writing processor 190.

The controller 110 comprises a Central Processing Unit (CPU) and the like and controls operations of each unit of the image forming system A in an integrated manner based on various processing programs stored in the program memory 121. For example, the controller 110 switches a copy mode, a printer mode, or a scanner mode based on an instruction signal inputted from the operation display unit 30 or the external apparatus 3, to control the operation of coping, printing, reading of image data and the like by reading a processing program corresponding to each mode stored in the program memory 121.

In order to realize this embodiment, the controller 110 reads a recording medium/special sheet feeding response processing program related to this embodiment from the program memory 121 and reads job data from the nonvolatile memory 130 to control a processing of discharging unnecessary tab paper by cooperating with the above mentioned program and data.

In case that the operation display unit 30 or the external apparatus 3 receives the specified page number as a page position at which tab paper is inserted and an instruction for dividing printed matter into a plurality of groups, in order to set the tab paper which is the top of the inserted tab papers to the tab paper arranged at the top of one set of the tab paper group for each group, the controller 110 realizes a function as a control unit to discharge the tab paper which is not inserted into the group into which tab paper is inserted, to the outside of the image forming system A, when the above not-inserted tab paper exists in one set including a final tab paper inserted into the group.

The case that the unnecessary tab paper which is not inserted into the group into which tab paper is inserted, exists in one set including a final tab paper inserted into the group, is the case that the number of sheets of unnecessary tab paper for each group (the value shown by an unnecessary tab paper discharge counter, which will be described later) is not 0 or is not the number of sheets in one set. In this case, the controller 110 discharges the tab paper out of the image forming system A.

In the case that the number of sheets of unnecessary tab paper is not 0 or is not the number of sheets constituting one set as described above, an unnecessary tab paper can be discharged out of the image forming system A. Thus, the unnecessary tab paper can be appropriately discharged and tab paper can be sequentially inserted from the top of one set for each group.

When the number of sheets of tab paper (the number of tabs) constituting one set is "n" and the number of sheets of tab paper inserted into the group (the value shown by a special sheet counter, which will be described later) is "m," the controller 110 calculates a value X by the following formula (1) as the number of sheets of unnecessary tab paper and discharges the X sheets of tab paper out of the image forming system A.

$$X = n - (\text{remainder of } m/n) \qquad \text{formula (1)}$$

As described above, the number sheets of tab paper to be discharged is calculated by the formula (1). Thus, the number of sheets of tab paper to be discharged can be found in a simple and secure manner. Further, unnecessary tab paper can be appropriately discharged.

For example, the case that tab paper is inserted into each group, is the case that, in the individual page conditions list area G23*c* in which the page unit setting check box G23*a* is checked, a plurality of stapling end positions are specified and an insertion of blank paper is specified before the document page having a specified end position of stapling.

The controller 110 also recognizes setting information (job data) for each job and tab paper setting information inputted from the external apparatus 3 through the operation display unit 30 or the printer controller 1*b*.

In the embodiment, job data is inputted from the external apparatus 3 as shown in FIG. 3 and FIG. 4. However, job data may be inputted from the operation display unit 30.

As tab paper setting information, for example, the information is one showing how many sheets of tab paper constitute one tab paper set to be used, one showing the size of tab paper, and one showing paper feeding tray storing tab paper. The tab paper setting information is inputted through the operation display unit 30 when one tab paper set is stored in a paper feeding tray.

The program memory 121 comprises a nonvolatile memory such as semiconductor, and stores, for example, a system program corresponding to the image forming apparatus 1, a recording medium/special sheet feeding response processing program that can be executed on the system program, and data for setting post processing of a main contents recording medium on which an image is formed, to the post-processing unit 50 via the print unit 40. A program is stored in the form of a computer-readable program code and operations are performed successively in accordance with the controller 110 and the program code.

The RAM 122 is a memory unit that functions as a temporary storage region for storing a program read out from the program memory 121, an input or output data, and a parameter and the like in various processing executed and controlled by the controller 110.

The nonvolatile memory 130 is a memory unit for storing tab paper setting information and job data.

FIG. 5 illustrates an example of job data.

As shown in FIG. 5, job data 131 includes: data common to each document page (page common data 131*a*) and data for each document page (individual page data 131*b*).

The page common data 131*a* includes: various setting information that is set based on instruction signals inputted via the external apparatus 3 or the operation display unit 30; and data showing the operational state of an image forming operation and a post-processing operation.

The page common data 131*a* in this embodiment includes, for example, a set print run D1 showing the number of main recording media to be outputted; an outputted print run D2 showing the number of the outputted main recording media; a copy mode D3 showing a surface on which an image data is formed, that is, one side print to both sides print, both sides print to one side print and the like, a post-processing mode D4 showing the type of a set post-processing (the presence of stapling, stapling position and the like); an intersheet D5 showing whether a function for inserting a tab paper (intersheet function) is applied or not, based on the individual page conditions list area G23*c*; an insertion mode D6 showing a print setting to tab papers (whether blank paper image is formed or not, setting of a surface on which an image is formed); a specified page group D7 having a plurality of specified pages showing page numbers at which tab paper is inserted; a main contents paper feeding tray D8 showing a paper feeding tray for storing a main contents recording medium on which an image is formed; a tab paper tray D9 showing a paper feeding tray which stores tab paper; and the number of sheets of already-read image(s) D10 showing the total number of sheets of already-read document pages, and the like.

It is noted that D7*a*, D7*b*, D7*c*, . . . , and D7*m* represent each of specified pages 1 to m of the specified page group D7 and the page numbers at which tab paper is inserted, and which are shown by each of the specified pages 1 to m are arranged in an ascending order of the numbers shown by the page numbers.

The page common data 131*a* also includes: an output page D11 showing the page number of a document page to be outputted next; a paper feeding counter D12 showing the number of main contents recording media fed in order to form images based on the document pages; an insertion pointer D13 showing a specified page storing a page number at which tab paper is inserted; an unnecessary tab paper discharge flag D14 showing that unnecessary tab paper is being discharged; an unnecessary tab paper discharge counter D15 showing the number of sheets of unnecessary tab paper which is not discharged; and a tab paper counter D16 showing the number of sheets of fed tab paper.

Individual page data includes: an image storage address D21 showing an address of the image memory 170 at which image data (individual image data) corresponding to each read document page is stored, to the individual image data; post-processing information D22 showing a post processing (in this case, whether stapling is performed or not) for each document page (i.e., individual image data) set by the individual page conditions list area G23*c*; and division information D23 showing a division position (in this case, whether a stapling end position is specified or not) for each document page (i.e., individual image data).

The reading processor 140 carries out various processing, such as an analog processing, an A/D conversion processing, a shading processing and the like, for an analog image signal inputted from the image reading controller 200 of the image reader 20 to subsequently generate digital image data. The generated image data is outputted to the compression IC 150.

The compression IC 150 carries out a compression processing for the inputted digital image data to output the data to the DRAM control IC 160.

Based on the instruction from the controller 110, the DRAM control IC 160 controls a compression processing of digital image data by the compression IC 150 and a decompression processing of compressed image data by the decompression IC 180 and controls an input and an output of the image data to the image memory 170. For example, when it is instructed to store an analog image signal read out by the image reader 20, a compression processing of the digital image data inputted from the reading processor 140 is performed by the compression IC 150 and the compressed image data is stored in the compression memory 171 of the image memory 170. When the printout of compressed image data stored in the compression memory 171 is instructed, the compressed image data is read out from the compression memory 171 and the decompression processing is carried out by the decompression IC 180 to store the image data in the page memory 172. When a printout of the uncompressed image data stored in the page memory 172 is instructed, the uncompressed image data is read out from the page memory 172 to output the image data to the writing processor 190.

The image memory 170 includes: the compression memory 171 having a Dynamic RAM (DRAM) and the page memory 172. The compression memory 171 is a memory for storing compressed image data. The page memory 172 is a memory for temporarily storing uncompressed image data to be printed out.

The decompression IC 180 carries out the decompression processing for the inputted compressed image data.

The writing processor 190 generates printing data for an image forming based on uncompressed image data inputted from the DRAM control IC 160 to output the data to the print unit 40.

The image reader 20 comprises the image sensor 22*a*, the image reading controller 200 and the like. Further, in the embodiment, the image reader 20 comprises the automatic document feeder 21 and the reader 22 that are shown in FIG. 1 and that are not shown in FIG. 2. The image reading controller 200 controls the automatic document feeder 21, the reader 22 and the like so that a surface of a document placed on a contact glass is exposed and scanned. Then, the photoelectric conversion is carried out for the reflecting light by the image sensor 22*a* to read an image. The read analog image signal is outputted to the reading processor 140 of the main body controller 100.

The operation display unit 30 comprises: a Liquid Crystal Display (LCD) 31; an operation display controller 300; and an operation key group (not shown). A touch panel is provided on the LCD 31 so as to cover the LCD 31. The operation display controller 300 displays a various setting screen for inputting various setting conditions, various processing results and the like on the LCD 31 in accordance with a display signal inputted from the controller 110. The operation display controller 300 outputs an operation signal inputted from the operation key group or the touch panel, to the controller 110.

The operation display unit 30 also realizes a function of the special sheet setting input unit capable of receiving the number of sheets of tab paper constituting one set to be used.

It is noted that the operation display unit 30 also may have another configuration as described below. Specifically, the operation display unit 30 displays a screen having substantially the same contents as those of various setting screens as shown in FIG. 3 and FIG. 4 on the LCD 31 so as to realize a function as that special sheet setting input unit for accepting the specification of a page at which tab paper is inserted into a plurality of main recording media and a function as the division setting input unit for accepting the instruction for dividing printed matter having a plurality of main recording media into a plurality of groups (booklets).

FIGS. 6A to 6H illustrate examples of various setting screens displayed on the LCD 31 of the operation display unit 30. The operation for instructing the setting of tab paper setting information by using the various setting screen, will be explained.

Figure 6A:
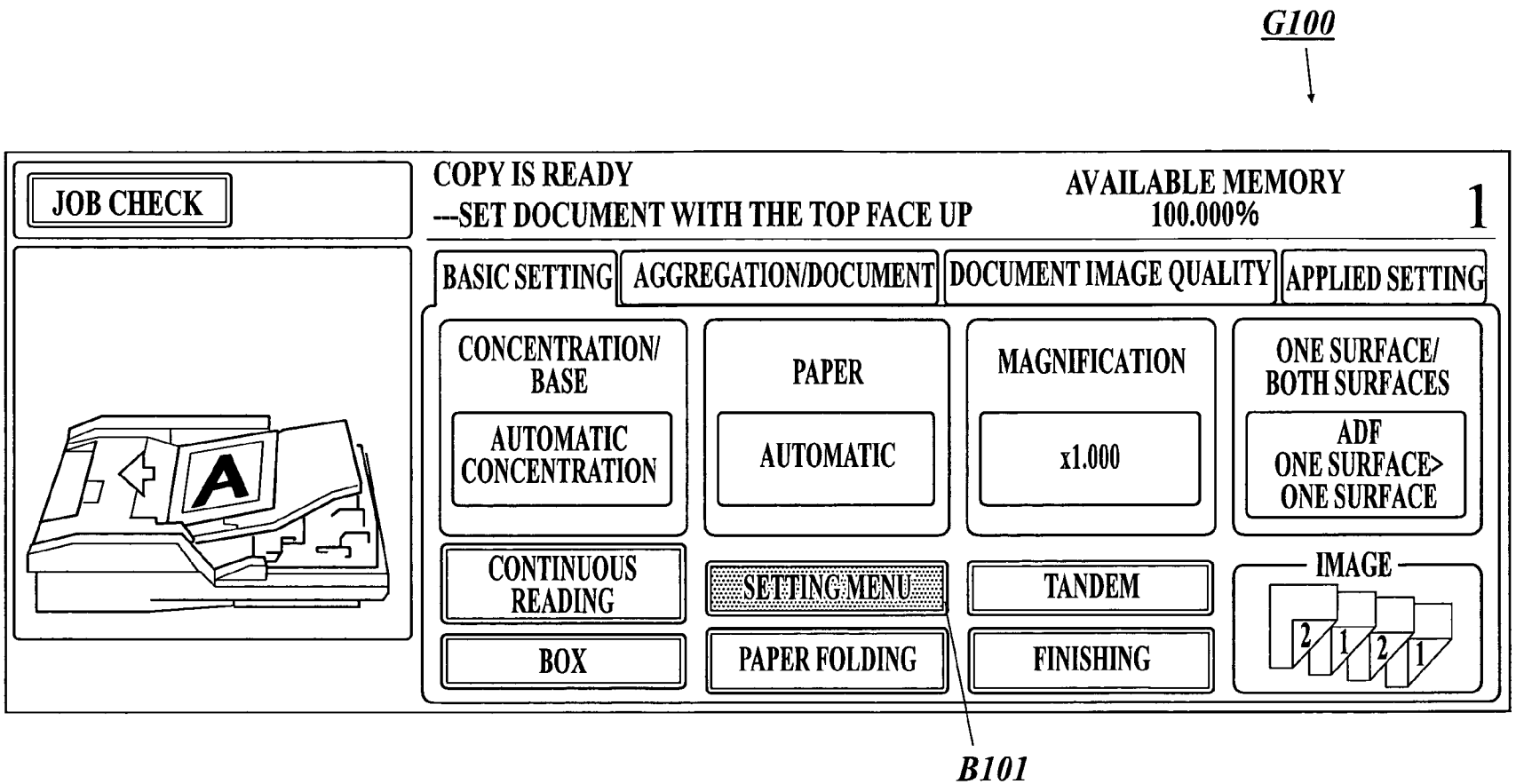
FIG. 6A illustrates a basic setting screen G100 in the state that a setting menu button B101 is depressed.

First, one set to be used is stored in any of the paper feeding trays 41*a*, 41*b*, or 41*c*. Then, as shown in FIG. 6A, a setting menu button B101 provided on a basic setting screen G100 is depressed in order to set a basic setting for an operation of the image forming system A.

Figure 6B:
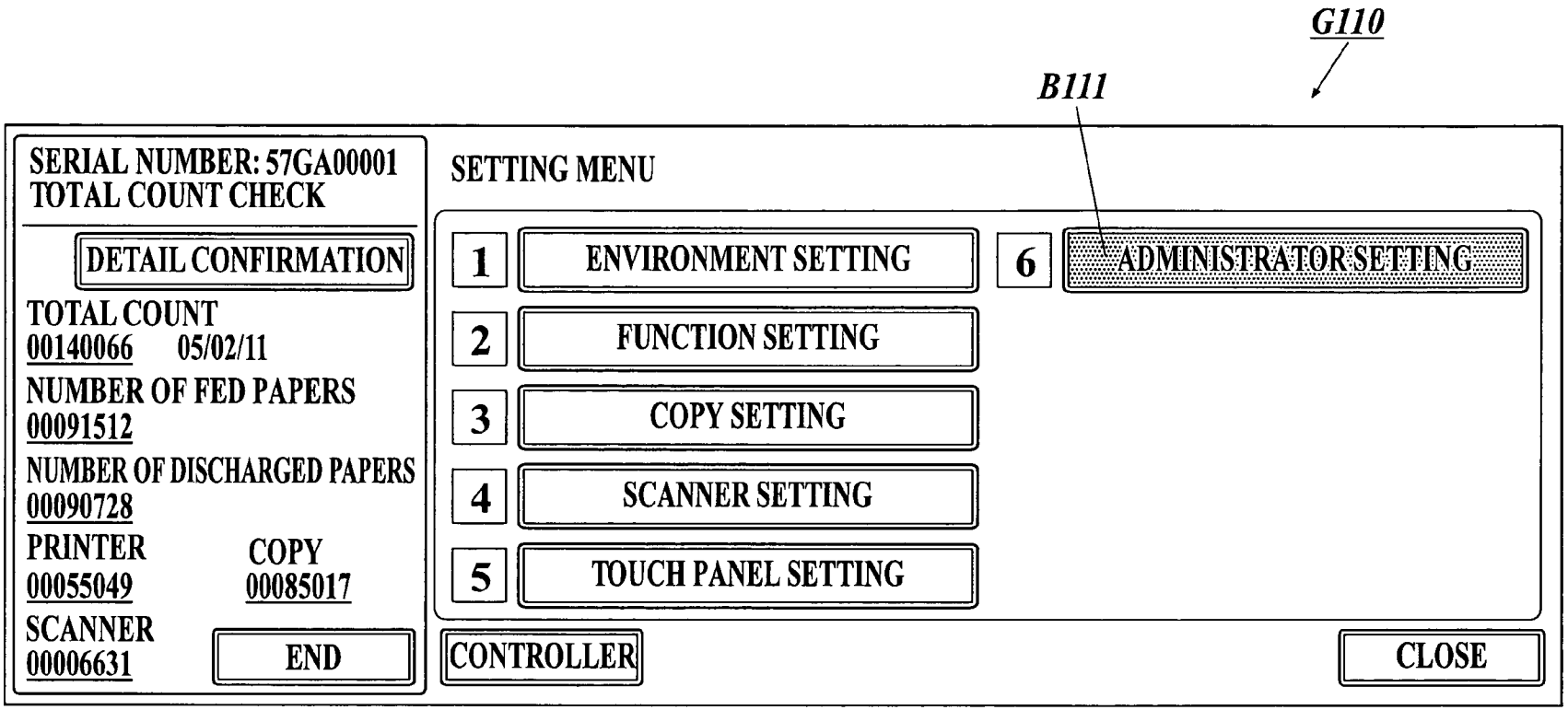
FIG. 6B illustrates a setting menu screen G110 in the state that an administrator setting button B111 is depressed.

When the setting menu button B101 is depressed, a setting menu screen G110 for selecting various setting menus as shown in FIG. 6B is displayed. Then, an administrator setting button B111 provided on this setting menu screen G110 is depressed.

Figure 6C:
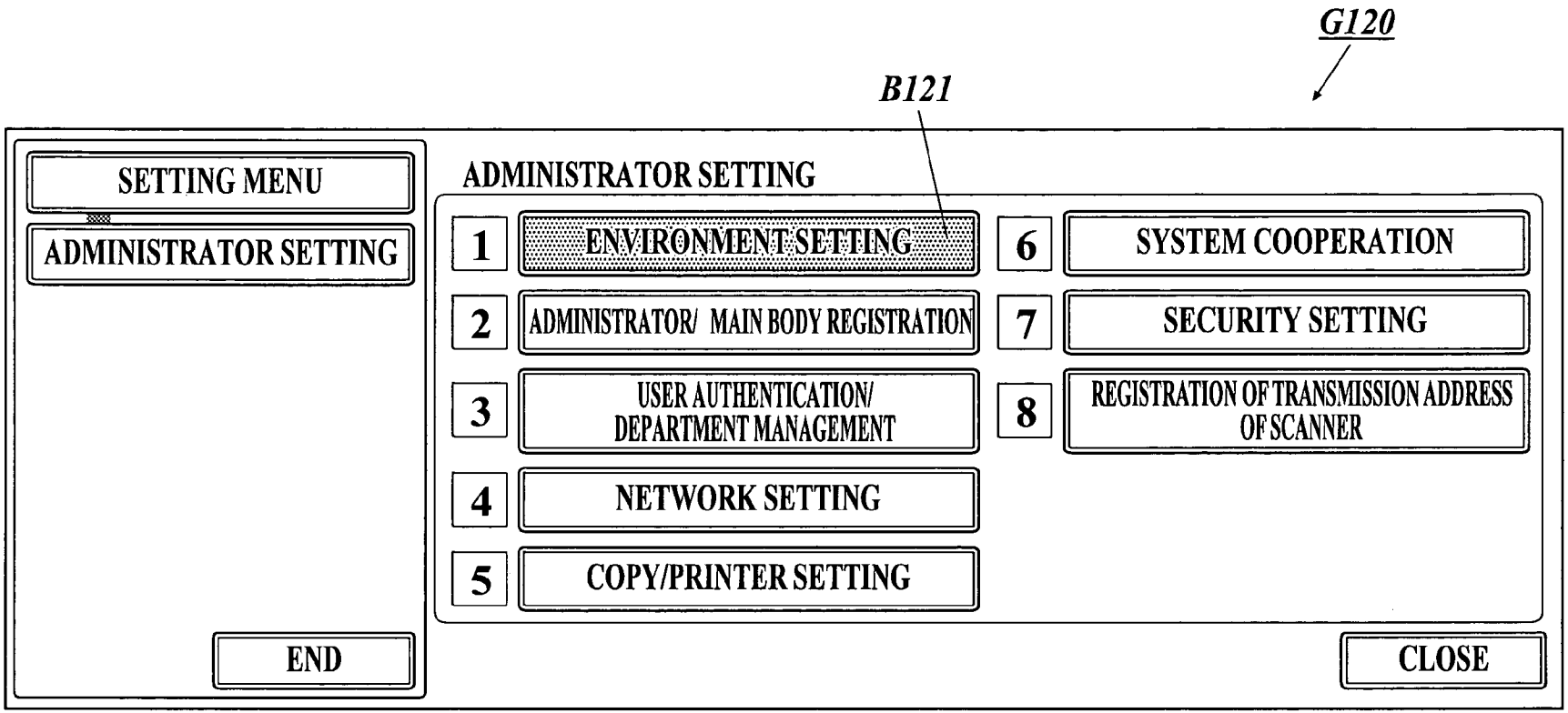
FIG. 6C illustrates an administrator setting screen G120 in the state that an environment setting button B121 is depressed.

When the administrator setting button B111 is depressed, an administrator setting screen G120 in which items that can be set by an administrator (user) are displayed as shown in FIG. 6C. Then, an environment setting button B121 provided on this administrator setting screen G120 is depressed.

Figure 6D:
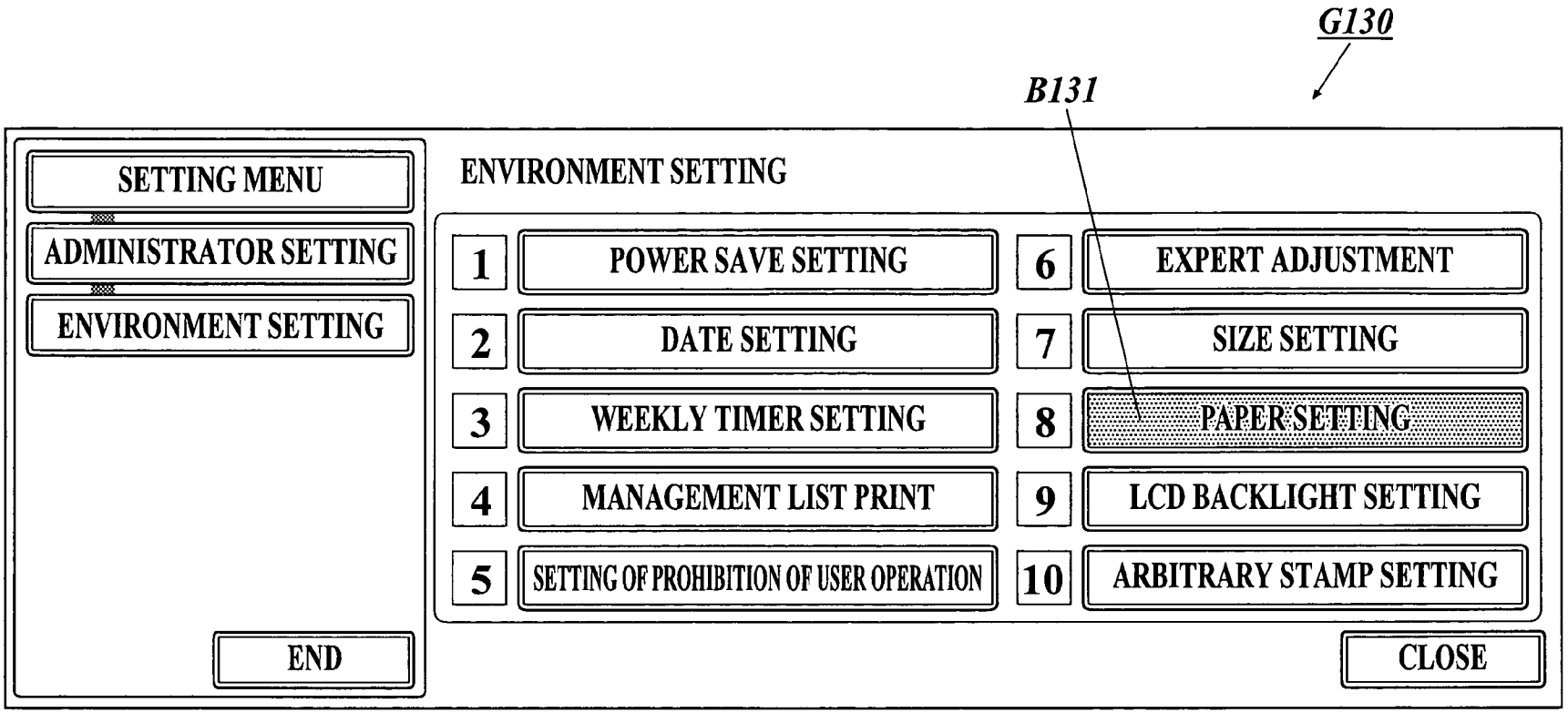
FIG. 6D illustrates an environment setting screen G130 in the state that a paper setting button B131 is depressed.

When the environment setting button B121 is depressed, an environment setting screen G130 in which various environment setting items for the image forming system A are displayed, is displayed as shown in FIG. 6D. Then, a paper setting button B131 provided on this environment setting screen G130 is depressed.

Figure 6E:
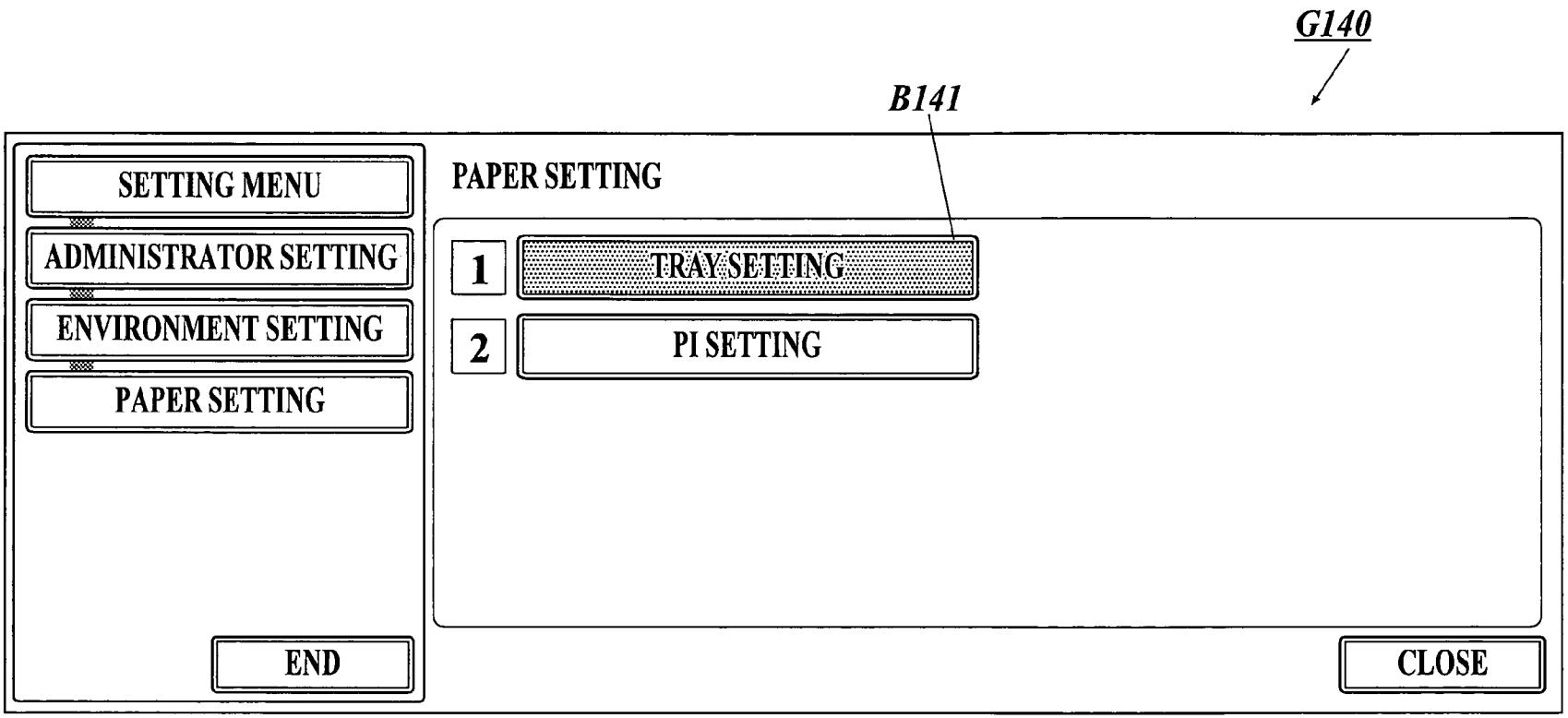
FIG. 6E illustrates a paper setting screen G140 in the state that a tray setting button B141 is depressed.

When the paper setting button B131 is depressed, a paper setting screen G140 in which various items for paper setting are displayed, is displayed as shown in FIG. 6E. Then, a tray setting button B141 provided on this paper setting screen G140 is depressed.

Figure 6F:
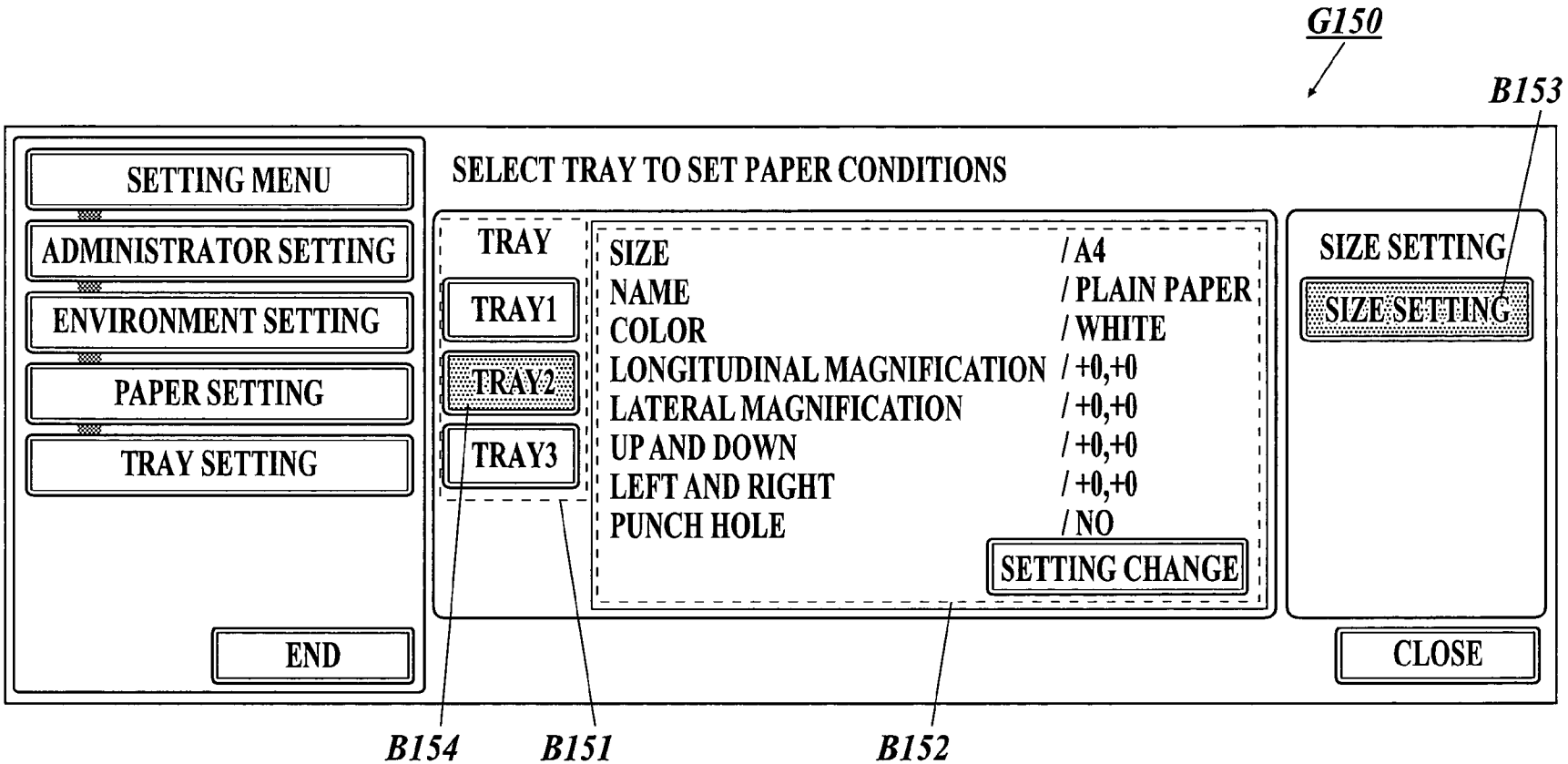
FIG. 6F illustrates a tray setting screen G150.

When the tray setting button B141 is depressed, a tray setting screen G150 in which a tray selection button group B151 for selecting a paper feeding tray; a display area B152 showing the information set to the selected paper feeding tray; and a size setting button B153 for setting the size to the information displayed in the display area B152, are displayed, is displayed as shown in FIG. 6F.

In this tray setting screen G150, a tray selection button showing a paper feeding tray storing one set (in this embodiment, tray 2 button B154) is selected from among the tray selection button group B151 and is depressed. After the information set to the depressed tray 2 button B154 is displayed in the display area B152, the size setting button B153 is depressed.

Figure 6G:
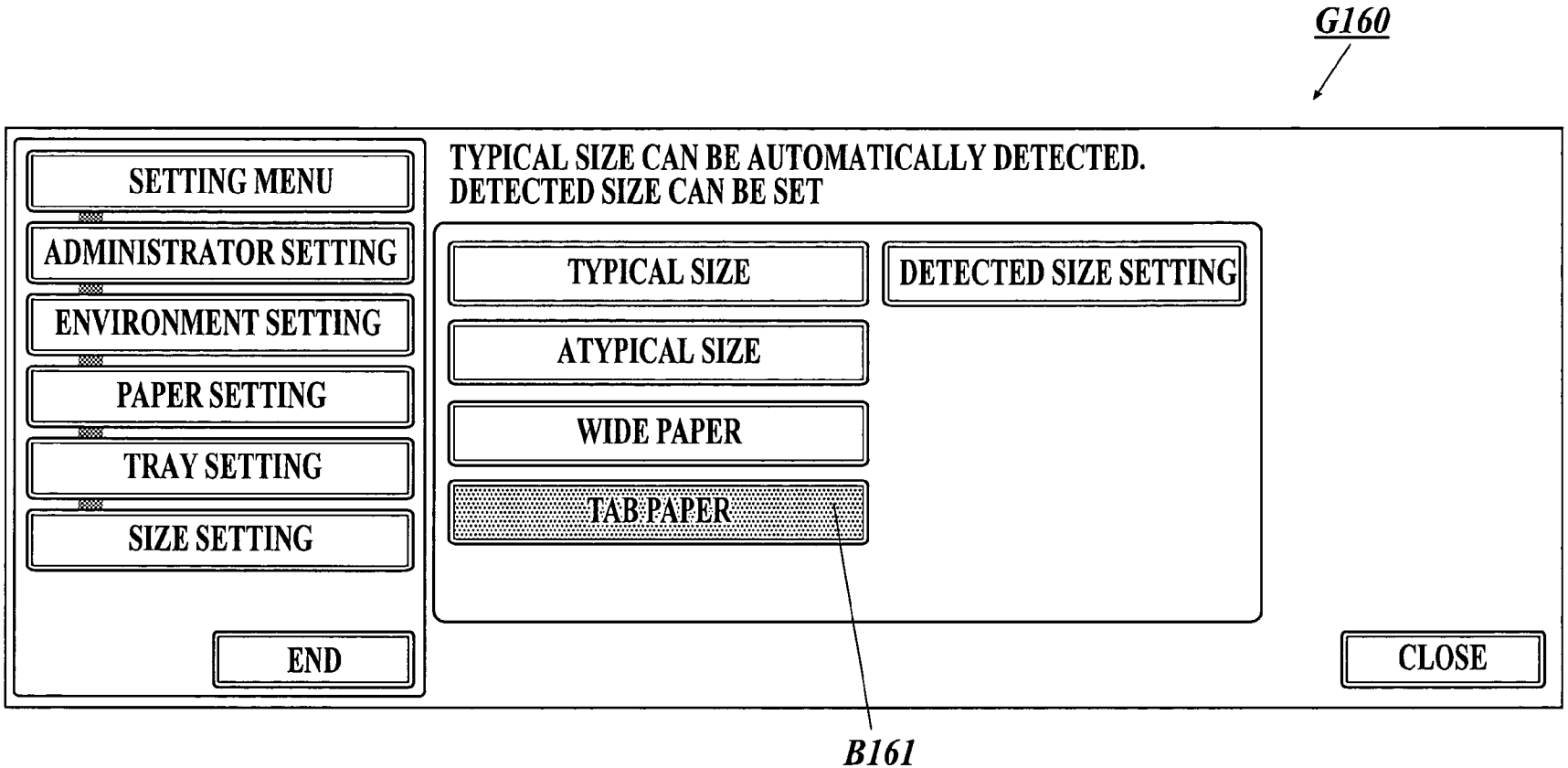
FIG. 6G illustrates a size setting screen G160.

When the size setting button B153 is depressed, a size setting screen G160 in which various buttons for selecting the size of the recording medium P stored in the paper feeding tray (tray 2) selected by the tray 2 button B154 are displayed, is displayed as shown in FIG. 6G. Then, a tab paper button B161 provided on this size setting screen G160 is depressed.

Figure 6H:
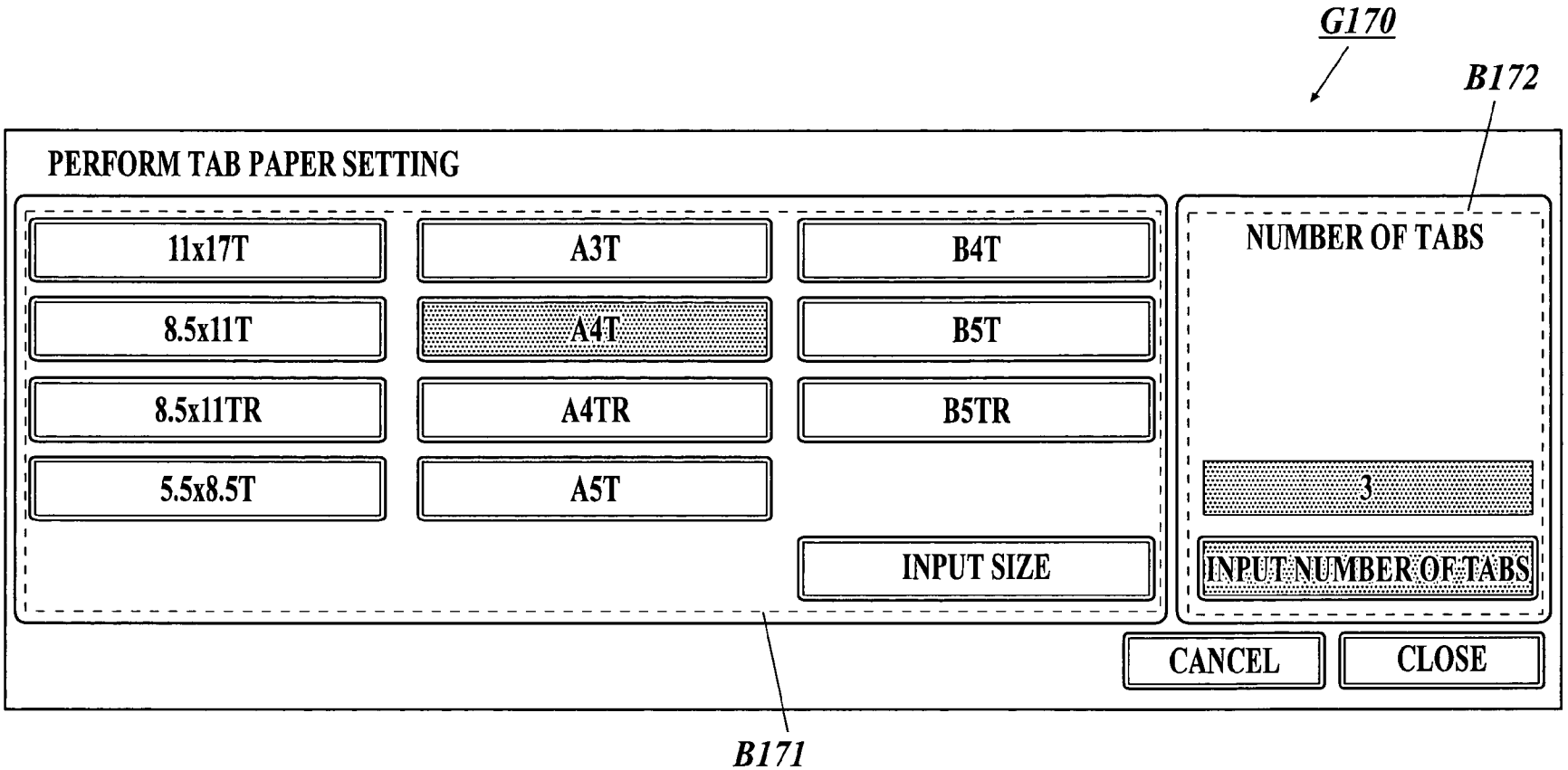
FIG. 6H illustrates a tab paper setting screen G170.

When the tab paper button B161 is depressed, a tab paper setting screen G170 in which a size selection button group B171 for showing the sizes of tab papers; and the-number-of-tabs input area B172 for setting the number of tab papers constituting one set (the number of tabs) are displayed, is displayed as shown in FIG. 6H.

In this tab paper setting screen G170, a button showing the size of tab paper stored in the paper feeding tray (tray 2) selected by the tray 2 button B154 is selected from among the size selection button group B171 and is depressed to set the size of the tab paper. Then, the number of tabs is set in the-number-of-tabs input area B172 to set the number of sheets of tab paper constituting one set.

By performing the operations as shown in FIGS. 6A to 6H, the nonvolatile memory 130 memorizes tab paper setting information, such as a paper feeding tray storing tab paper groups, the size of tab paper, the number of tabs and the like.

The print unit 40 comprises each unit related to printout, such as image forming unit 43 shown in FIG. 1, and the print controller 400. The print controller 400 controls the operations of each unit of the print unit 40, such as the image forming unit 43, in accordance with an instruction from the controller 110, forms an image on the recording medium P based on print data inputted from the writing processor 190, and outputs an instruction signal for operating each unit of the post-processing unit 50 to the post-processing controller 500 based on the instruction from the controller 110.

Next, each unit of the printer controller 1*b* will be described. When the image forming system A is used as a network printer, the printer controller 1*b* manages and controls print jobs inputted from the external apparatus 3 connected to the network N to the image forming system A. The printer controller 1*b* has a function to receive printing data to be printed from the external apparatus 3 and to allocate the data as a print job depending on the operational state of the image forming system A.

The printer controller 1*b* comprises: a controller controlling unit 11*b*, a DRAM control IC 12*b*, an image memory 13*b* and LANIF 14*b*.

The controller controlling unit 11*b* realizes a function to control the operations of each unit of the printer controller 1*b* in an integrated manner and to distribute the data inputted from the external apparatus 3 via the LANIF 14*b* as job data according to the operational state of the image forming system A, to the main body 1*a*.

The DRAM control IC 12*b* controls the storage of the data received by the LANIF 14*b* in the image memory 13*b* and the reading of data from the image memory 13*b*. The DRAM control IC 12*b* is also connected to the DRAM control IC 160 of the main body controller 100 via a Peripheral Components Interconnect (PCI) bus and reads printing data to be printed from the image memory 13*b* in accordance with the instruction from the controller controlling unit 11*b*, to output the data to the DRAM control IC 160.

The image memory 13*b* comprises DRAM and temporarily stores inputted output data.

The LANIF 14*b* is a communication interface, such as Network Interface Card (NIC), modem or the like for connecting the network N, such as LAN, and receives data from the external apparatus 3. The received data is outputted to the DRAM control IC 12*b*.

The post-processing apparatus 2 comprises a sort unit, a punching unit, a stapling unit, a folding unit, and a cutting unit or the like. Further, the post-processing apparatus 2 comprises a conveying unit, such as a conveying roller, for conveying a recording medium to each post-processing unit. Each post-processing unit is controlled by the post-processing controller 500 in an integrated manner. The post-processing controller 500 controls each unit so as to convey the recording medium P along a conveyance path to a predetermined post-processing unit, to perform the predetermined post-processing for the recording medium P, and to discharge the recording medium to the predetermined paper discharging tray T3 or the unnecessary paper discharging tray T4, in accordance with a post-processing instruction signal inputted from the controller 110 via the print controller 400.

Next, the operation of this embodiment will be described.

Figure 7:
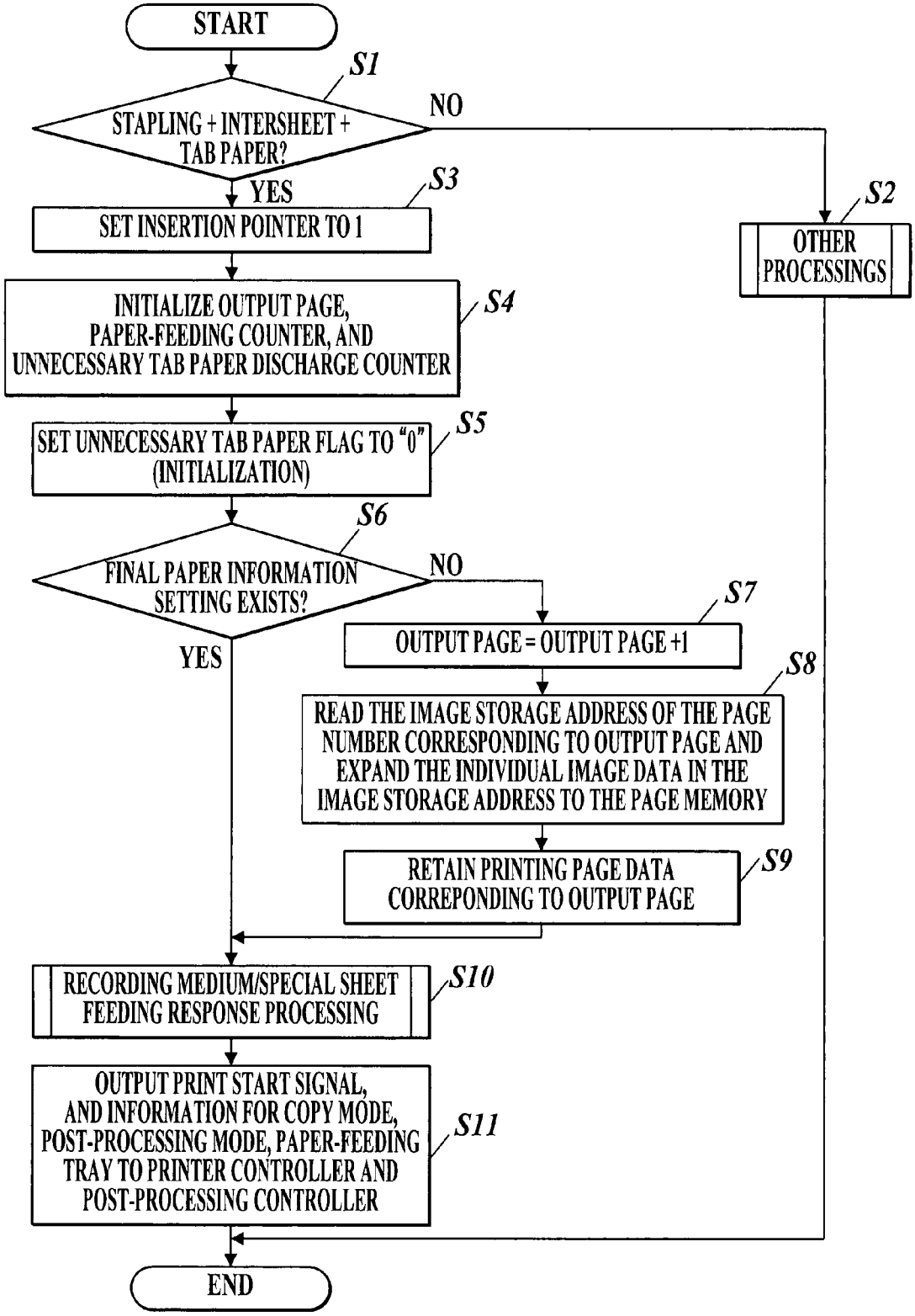
FIG. 7 is a flowchart illustrating a recording medium/special sheet feeding response processing in this embodiment.
Figure 8:
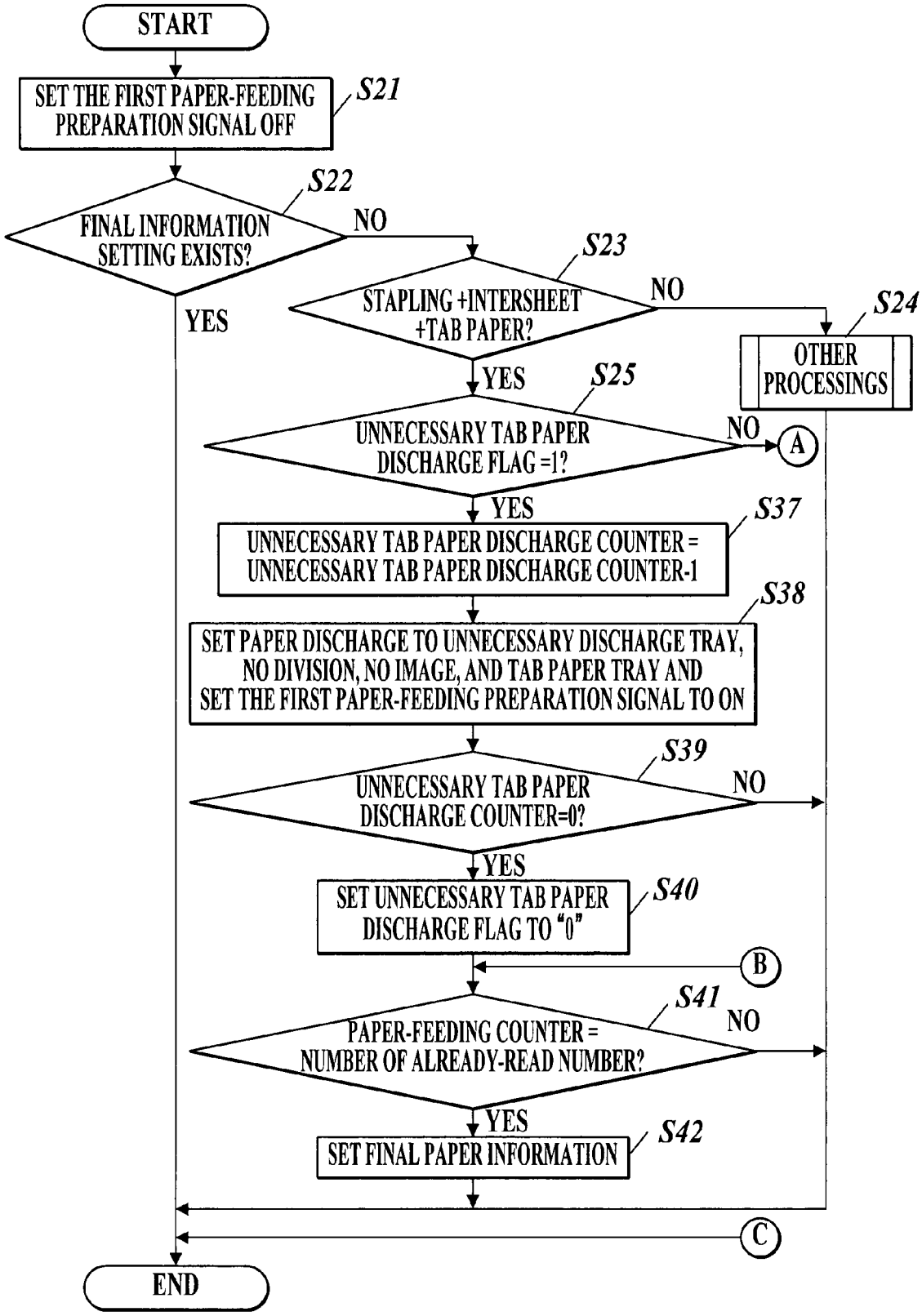
FIG. 8 is a flowchart illustrating a recording medium/special sheet feeding response processing in this embodiment.
Figure 9:
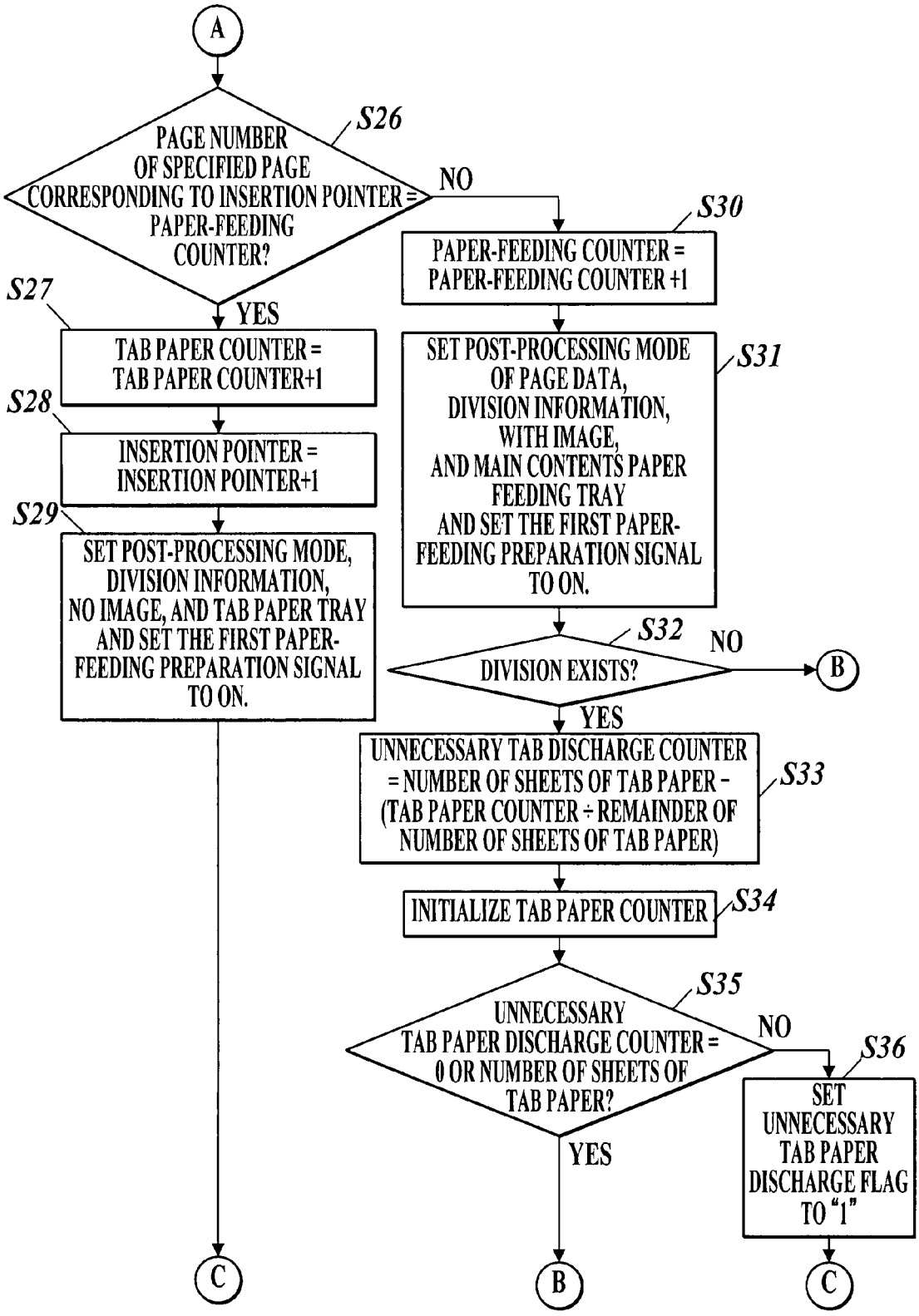
FIG. 9 is a flowchart illustrating a recording medium/special sheet feeding response processing in this embodiment (continuation from FIG. 8)

FIGS. 7 to 9 are flowcharts illustrating a recording medium/special sheet feeding response processing in this embodiment. The flowcharts shown in FIGS. 7 to 9 shows processing executed by the controller 110.

The flowchart shown in FIG. 7 shows processing performed when a print processing is started.

Prior to the print processing, the controller 110 firstly memorizes various setting information and the image data as job data on the nonvolatile memory 130 when the various setting information and the image data are inputted. The various setting information includes tab paper setting information set by the external apparatus 3 or the operation display unit 30, a page at which tab paper is inserted into a plurality of main recording media, an instruction for dividing printed matter having a plurality of main recording media into a plurality of groups (booklets) and the like. Further, the controller 110 also refers to the job data and tab paper setting information to determine whether the post-processing mode D4 is set to a stapling operation or not, whether the function of the intersheet D5 is set or not, and whether tab paper is inserted or not (Step S1).

When the controller 110 determines that the post-processing mode D4 is set to a stapling operation, that the function of the intersheet D5 is set, and that it is not set that a tab paper is inserted (Step S1; No), the controller 110 performs another processing, for example, various processing corresponding to a stapling processing in which tab paper is not inserted (Step S2). Then, this processing is completed.

When the controller 110 determines that the post-processing mode D4 is set to a stapling operation, that the function of the intersheet D5 is set, and that tab paper is inserted (Step S1; Yes), the controller 110 sets the insertion pointer D13 as "1" (Step S3), initializes the output page D11, the paper feeding counter D12, and the unnecessary tab paper discharge counter D15 (i.e., sets them to "0") (Step S4), and sets the unnecessary tab paper discharge flag D14 to "0" (Step S5).

After Step S5, the controller 110 determines whether final paper information is set or not (Step S6). The final paper information shows whether a final page of a main contents recording medium is already fed.

When the controller 110 determines that the final paper information is set (Step S6; Yes), the processing proceeds to Step S10.

When the controller 110 determines that the final paper information is not set (Step S6; No), the controller 110 adds "1" to the output page D11 (Step S7) and refers to an image storage address of the page number corresponding to the output page D11 to expand individual image data stored in this image storage address into a page memory and to generate printing page data (Step S8). Then, the printing page data of the page number corresponding to the output page D11 is retained (Step S9).

After Step S6 to Step S9, the controller 110 carries out a recording medium/special sheet feeding response processing which will be described later (Step S10) and outputs a print start signal and information about the copy mode D3 for the printing page data of the page number corresponding to the output page D11, whether a stapling is set or not, whether an end of a stapling is specified or not (whether division is set or not), a paper feeding tray, whether there is image data or not, to the print controller 400 and the post-processing controller 500 (Step S11). Then, this processing is completed.

FIG. 8 and FIG. 9 are flowcharts illustrating the recording medium/special sheet feeding response processing.

The recording medium/special sheet feeding response processing shown in FIG. 8 and FIG. 9 are processing that are performed only once, when the print processing as shown in FIG. 7 is started and that are repeatedly performed whenever a recording medium or special sheet is sent from the print controller 400 after the start of the print processing and until the final paper information is set.

The controller 110 sets the first paper feeding preparation signal to OFF (Step S21) and determines whether the final paper information is set or not (Step S22). When the controller 110 determines that the final paper information is set (Step S22; Yes), this processing is completed.

When the controller 110 determines that the final paper information is not set (Step S22; No), then the controller 110 refers to the job data and tab paper setting information to determine whether the post-processing mode D4 is set to a stapling operation, whether the function of the intersheet D5 is set or not, and whether tab paper is inserted or not (Step S23).

When the controller 110 determines that the post-processing mode D4 is set to a stapling operation, that the function of the intersheet D5 is set, and that it is that a tab paper is not inserted (Step S23; No), the controller 110 carries out another processing, such as a processing corresponding to a stapling processing in which tab paper is not inserted (Step S24). Then, this processing is completed.

When the controller 110 determines that the post-processing mode D4 is set to a stapling operation, that the function of the intersheet D5 is set, and that a tab paper is inserted (Step S23; Yes), the controller 110 determines whether the unnecessary tab paper discharge flag D14 is "1" or not (Step S25).

When the controller 110 determines that the unnecessary tab paper discharge flag D14 is not "1", that is, the unnecessary tab paper discharge flag D14 is "0" (Step S25; No), the controller 110 refers to the insertion pointer D13 and refers to a specified page shown by the insertion pointer D13 to determine whether the page number shown by this specified page is equal to a value of the paper feeding counter D12 or not (Step S26).

When the controller 110 determines that the page number shown by this specified page is equal to a value of the paper feeding counter D12 (Step S26; Yes), the controller 110 adds "1" to the tab paper counter D16 (Step S27) and adds "1" to the insertion pointer D13 (Step S28). The controller 110 also sets a post-processing mode (whether a stapling operation is set or not) and division information (whether the end of a stapling operation is specified or not), sets a paper feeding tray to a tab paper tray (in this embodiment, tray 2), sets that image data does not exist, sets the first paper feeding preparation signal which will be described later, to "ON" as information regarding the printing page data, and outputs the information to the print controller 400 and the post-processing controller 500 (Step S29). Then, this processing is completed.

When the controller 110 determines that the page number shown by the specified page is not equal to the paper feeding counter D12 (Step S26; No), the controller 110 adds "1" to the paper feeding counter D12 (Step S30), sets a post-processing mode (whether the stapling operation is set or not) and division information (whether the end of a stapling operation is specified or not), sets a paper feeding tray to a main contents paper feeding tray (in this embodiment, tray 1), sets that image data exists, and sets the first paper feeding preparation signal to "ON" as information regarding the printing page data (Step S31).

The controller 110 determines whether in Step S31, the end of a stapling operation (division) is specified or not (Step S32). When the controller 110 determines that the division is not specified (Step S32; No), the processing proceeds to Step S41.

When the controller 110 determines that in Step S31, the end of a stapling operation (division) is specified (Step S32; Yes), the controller 110 calculates the value X of the unnecessary tab paper discharge counter D15 by using the above-described formula (1) (Step S33) and initializes the tab paper counter D16 (sets the tab paper counter D16 to "0") (Step S34).

The controller 110 determines whether the value of the unnecessary tab paper discharge counter D15 equals to "0" or the number of tabs or not (Step S35).

When the controller 110 determines that the value of the unnecessary tab paper discharge counter D15 is equal to "0" or the number of tabs (Step S35; Yes), the controller 110 determines that there is no unnecessary tab paper to be discharged and the processing proceeds to Step S41.

When the controller 110 determines that the unnecessary tab paper discharge counter D15 is not equal to "0" or the number of tabs (Step S35; No), the controller 110 determines that there is unnecessary tab paper to be discharged and sets the unnecessary tab paper discharge flag D14 as "1" (Step S36). Then, this processing is completed.

On the other hand, when the controller 110 determines that the unnecessary tab paper discharge flag D14 is "1" (Step S25; Yes), the controller 110 reduces "1" from the value of the unnecessary tab paper discharge counter D15 (Step S37) and sets the unnecessary paper discharging tray T4 to one for discharging the unnecessary paper, sets that the end of a stapling operation (division) is not specified, sets a paper feeding tray to the tab paper tray (in this embodiment, tray 2), sets that the image data does not exist, and sets the first paper feeding preparation signal to "ON" (Step S38), as information regarding printing page data.

The controller 110 determines whether the value of the unnecessary tab paper discharge counter D15 is "0" or not (Step S39). When the controller 110 determines that the value of the unnecessary tab paper discharge counter D15 is not "0" (Step S39; No), this processing is completed.

When the controller 110 determines that the value of the unnecessary tab paper discharge counter D15 is "0" (Step S39; Yes), the controller 110 sets the unnecessary tab paper discharge flag D14 to "0" (Step S40) and determines whether the value of the paper feeding counter D12 is equal to the number of already-read image(s) D10 or not (Step S41).

When the controller 110 determines that the value of the paper feeding counter D12 is not equal to the number of already-read image(s) D10 (Step S41; No), this processing is completed.

When the controller 110 determines that the value of the paper feeding counter D12 is equal to the number of already-read image(s) D10 (Step S41; Yes), the controller 110 sets the final paper information (Step S42) and this processing is completed.

Figures 10A, 10B, 10C:
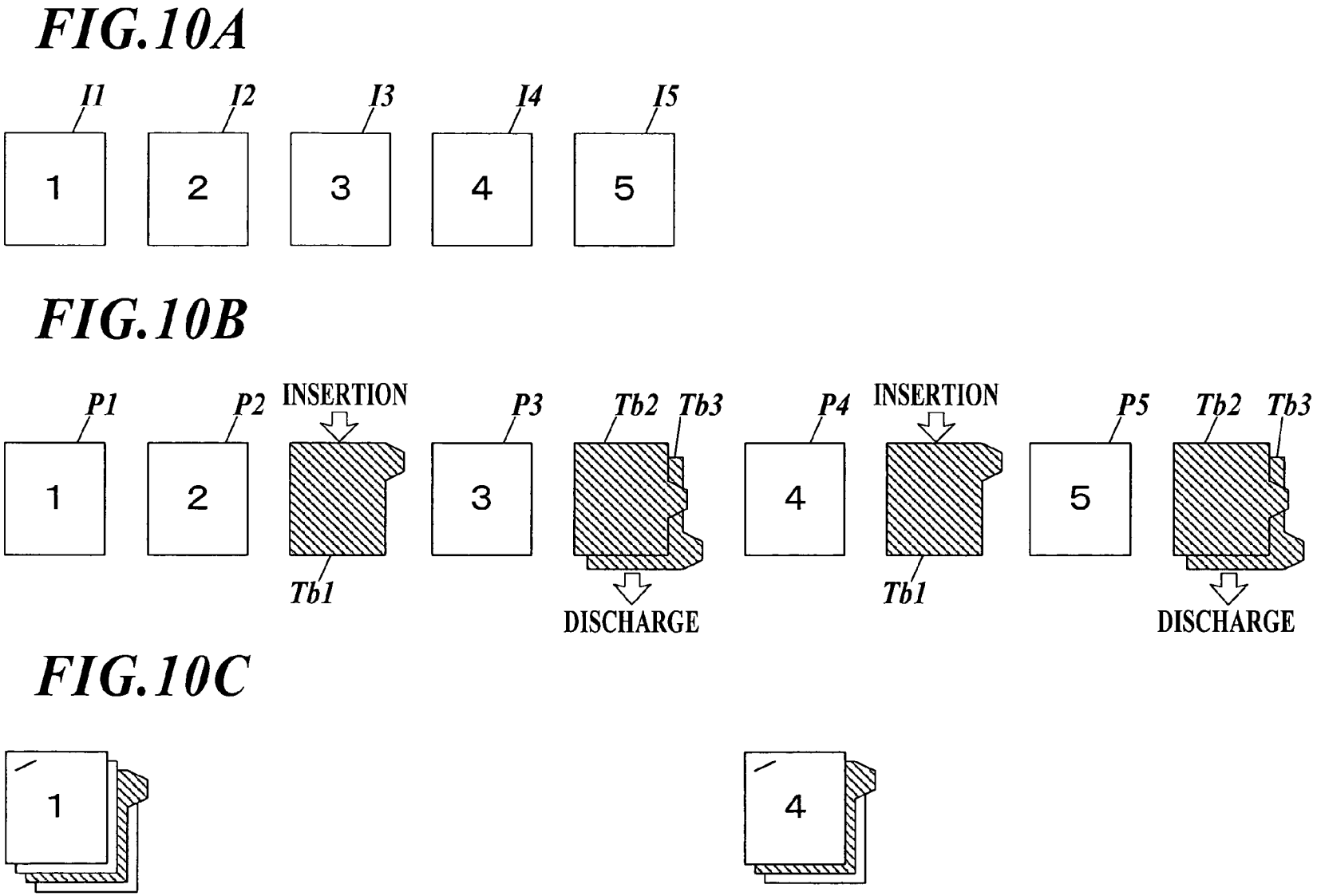
FIG. 10A illustrates the concept of image data having a plurality of individual image data corresponding to a plurality of document pages prepared by an application software in the external apparatus 3.
FIG. 10B illustrates the concept of the main contents recording media on which printing page data is formed based on the image data in the image forming apparatus 1 and tab papers to be inserted or discharged.
FIG. 10C illustrates the concept of bundles of recording media (booklet) after the stapling processing.
Figure 11A:
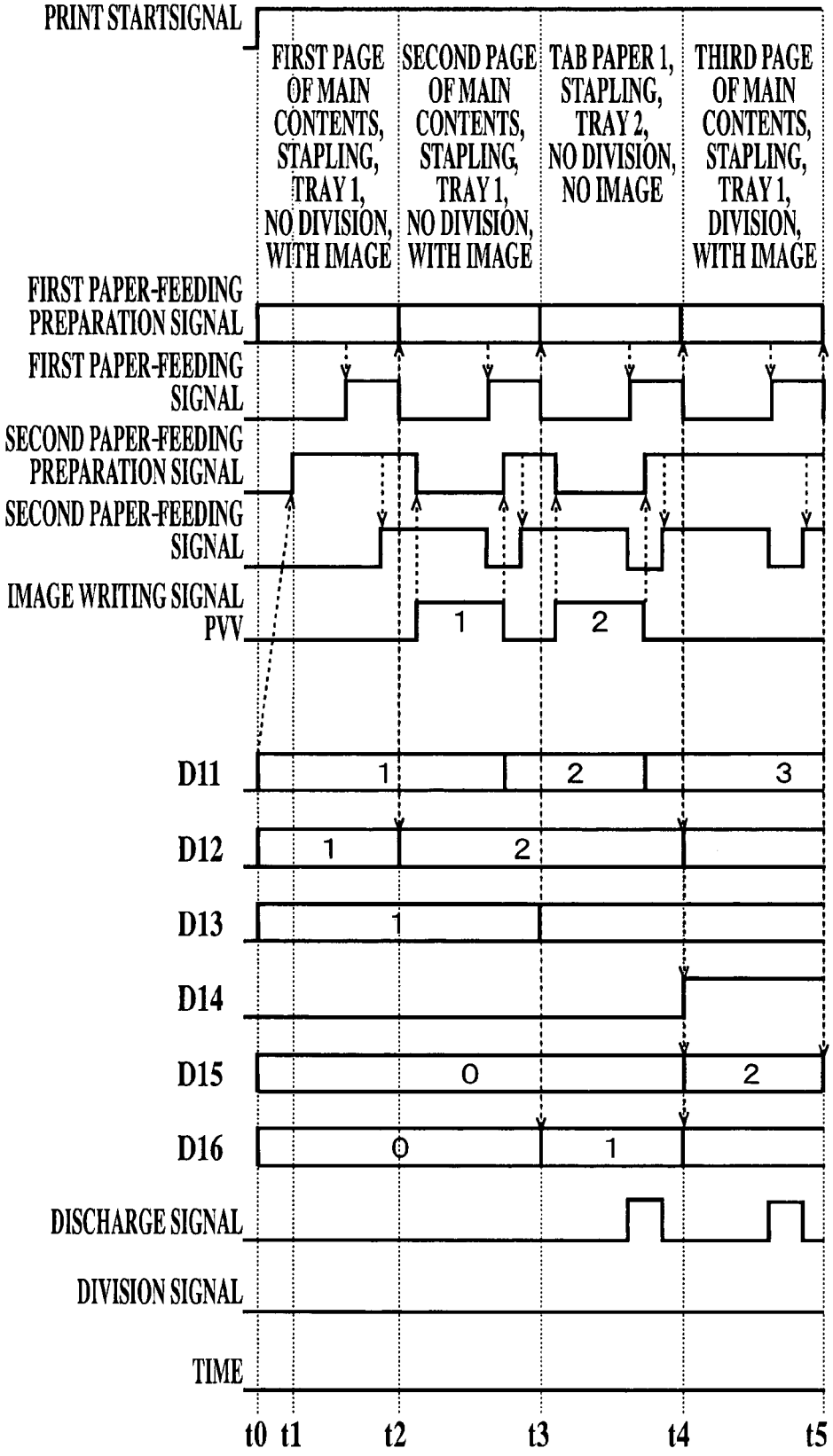
FIGS. 11A to 11C illustrate a time chart of an operation of the image forming system A which realizes the recording medium/special sheet feeding response processing shown in FIGS. 10A to 10C.
Figure 11B:
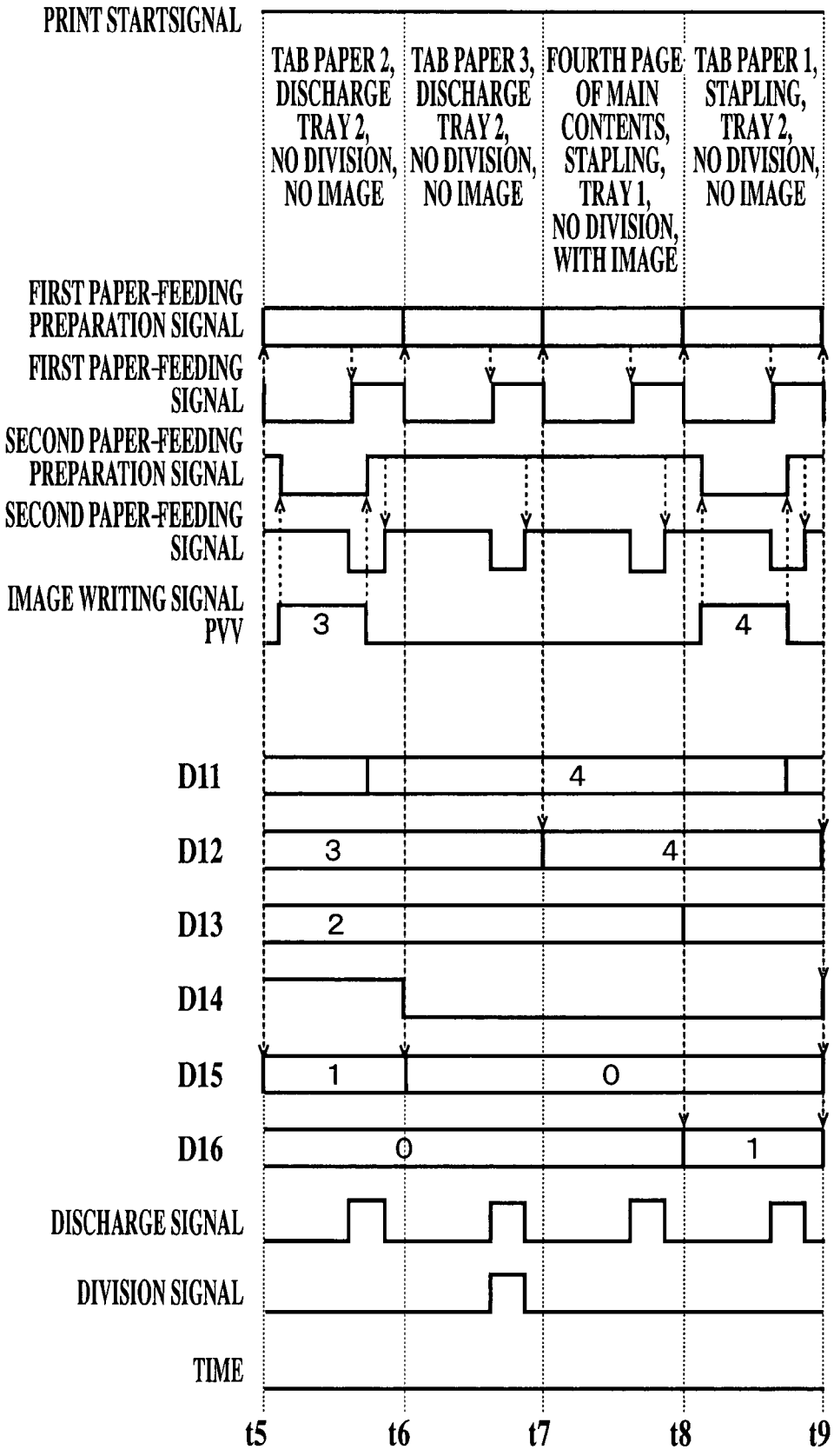
Figure 11C:
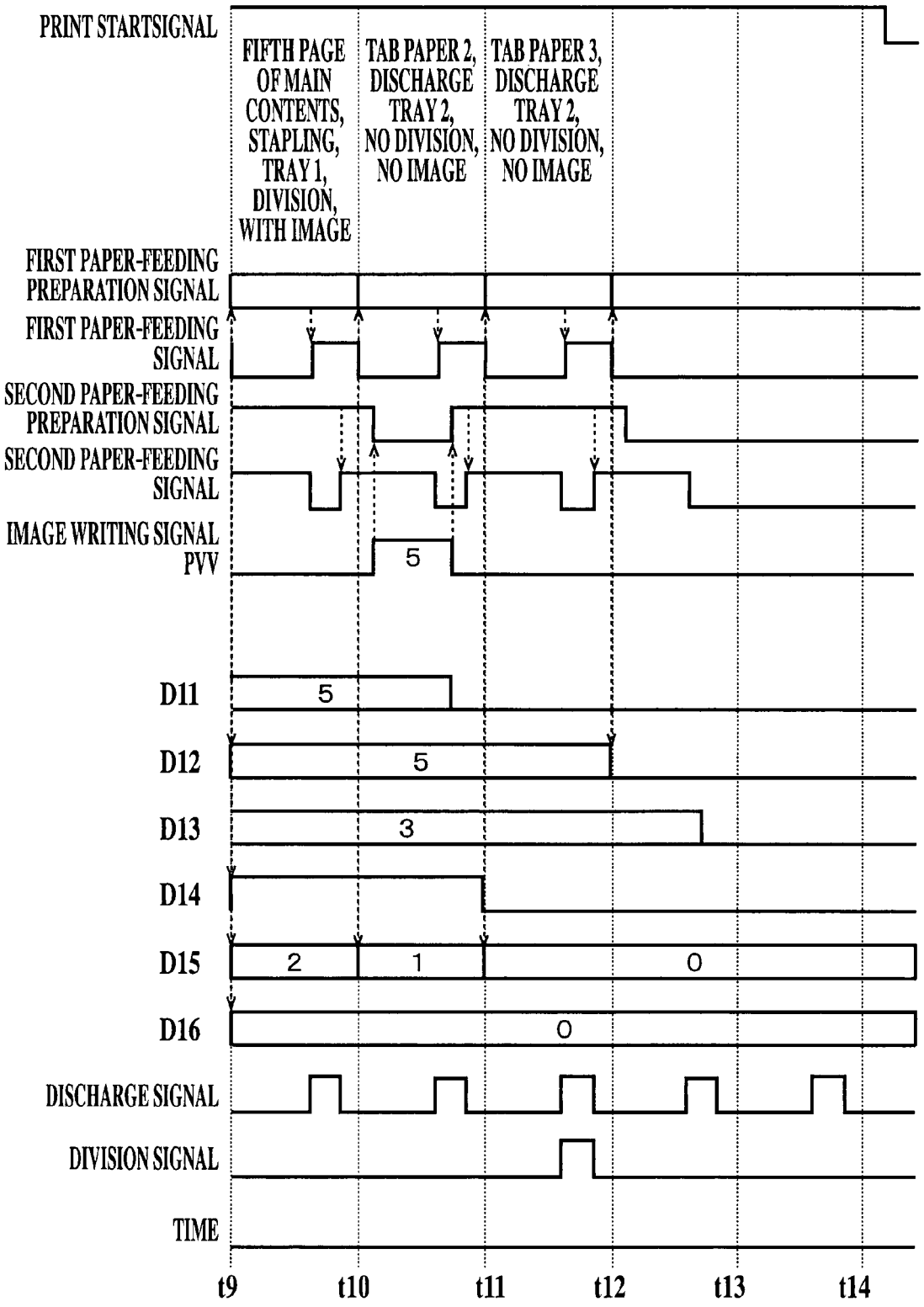

FIGS. 10A to 10C are concept diagrams illustrating the recording medium/special sheet feeding response processing executed in this embodiment. FIGS. 11A to 11C are a time chart of an operation of the image forming system A for realizing the recording medium/special sheet feeding response processing of FIGS. 10A to 10C.

FIGS. 11A to 10C and FIGS. 11A to 11C show an example of the recording medium/special sheet feeding response processing in a case that, in the various setting screen shown in FIG. 3 and FIG. 4, the staple check box G13*a* is checked, a stapling processing is set at one upper-left position, the page unit setting check box G23*a* is checked, each document page is processed based on various setting conditions shown in the individual page conditions list area G23*c*, and the tab paper stored in the tray 2 is set so as to be inserted.

FIG. 10A illustrates image data having a plurality of individual image data corresponding to a plurality of document pages prepared by application software in the external apparatus 3. FIG. 10B illustrates main contents recording media on which printing page data is formed based on the image data in the image forming apparatus 1 and tab papers to be inserted or discharged. FIG. 10C illustrates bundles of recording media (booklet) after the stapling processing.

The image data prepared by the external apparatus 3 shown in FIG. 10A includes individual image data I1 to I5 corresponding to each document page. When the image data is sent from the external apparatus 3 to the image forming system A, page numbers for identifying each individual image data (e.g., page 1, page 2, . . . ) are sequentially added to the individual image data I1 to I5 and are recorded as job data.

FIG. 10B illustrates an example in which the main contents recording media P1 to P5 on which images are formed by the image forming apparatus 1 in accordance with the printing page data based on the image data and one set including three tab papers Tb1 to Tb3 are inserted or discharged.

As shown in FIG. 10B, tab paper Tb1 is inserted between the main contents recording medium P2 as the second page and the main contents recording medium P3 as the third page. After the main contents recording medium P3 is formed at the third page, a stapling processing is carried out to prepare a booklet. Thus, in the one set including the tab paper Tb1 finally inserted into the booklet, tab papers Tb2 and Tb3 are discharged out of the image forming system A as unnecessary tab paper for the booklet before another special sheet is inserted into a booklet to be prepared, which follows the prepared booklet.

Thereafter, the tab paper Tb1 is inserted between the main contents recording medium P4 as the fourth page and the main contents recording medium P5 as the fifth page. After the main contents recording medium P5 is formed at the fifth page, a stapling processing is carried out to prepare a booklet. Thus, in the one set including the tab paper Tb1 finally inserted into the booklet, tab papers Tb2 and Tb3 are discharged out of the image forming system A as unnecessary tab paper for the booklet.

The image of the bundle (booklet) of recording media shown in FIG. 10C is prepared as a bundle (booklet) of the recording media which is the first group in which a stapling processing is carried out for main contents recording media P1 to P3 into which the tab paper Tb1 is inserted; and as a bundle (booklet) of the recording media which is the second group following the first group, in which a stapling processing is carried out for the main contents recording media P4 and P5 into which the tab paper Tb1 is inserted. These two bundles (booklets) of recording media are outputted as one printed matter. It is noted that, when a plurality of printed matters are outputted, these operations are repeated for the plurality of printed matters.

Next, an example of a time chart of an operation of the image forming system A shown in FIGS. 11A to 11C will be described.

The first paper feeding preparation signal is data including information for the set printing page data, such as information relating to whether a stapling operation is set or not, whether division is set or not, information for a paper feeding tray, information relating to whether an image exists or not, and is outputted from the controller 110 to the print controller 400 and to the post-processing controller 500 via the print controller 400.

The post-processing-related information, such as information relating to whether a stapling operation is set or not, whether division is set or not when a stapling operation is set, is outputted together with a paper discharge signal which will be described later, from the print controller 400 to the post-processing controller 500.

The first paper feeding signal is an operation signal for conveying the recording medium P from the specified paper feeding tray to the resist roller 42*a*. When the first paper feeding signal is ON, the signal represents that a conveyance operation is on the way. The first paper feeding signal is outputted from the print controller 400 to the controller 110 in accordance with the first paper feeding preparation signal.

The second paper feeding preparation signal is a signal showing whether an operation for writing printing page data can be performed or not. When the second paper feeding preparation signal is ON, the signal represents that the preparation for writing an image to be written next is ready. When the second paper feeding preparation signal is OFF, the signal represents that the preparation for the writing is on the way. The second paper feeding preparation signal is outputted from the controller 110 to the print controller 400.

The second paper feeding signal is an operation signal for conveying a recording medium from the resist roller 42*a* to the transfer device 43*a*. When the second paper feeding signal is ON, the signal represents that the conveyance operation is on the way. The second paper feeding signal is outputted from the print controller 400 to the controller 110 in accordance with the second paper feeding preparation signal.

The image writing signal PVV is a signal outputted from the print controller 400 to the controller 110. The image writing signal PVV is an operation signal for forming an electrostatic latent image by irradiating the photoconductor drum with laser light by using the exposure device of the image forming unit 43 based on the printing page data. When the image writing signal PVV is ON, the signal represents that the writing of an electrostatic latent image is on the way. The image writing signal PVV is outputted from the print controller 400 to the controller 110 in accordance with the second paper feeding preparation signal.

A paper discharge signal is an operation signal for discharging a recording medium on which an image is formed, from the print unit 40 to the post-processing unit 50. When the paper discharge signal is ON, the signal represents that a discharge operation is on the way. The paper discharge signal is outputted from the print controller 400 to the post-processing controller 500. At this time, the information relating to whether a staple operation is set or not, a discharge tray in case that the staple operation is not set, and whether the division is set or not in case that the staple operation is set, is outputted.

A division signal is a signal showing whether data of an image formed on a recording medium during a discharge operation is printing page data showing that the division of the stapling is set or not. When the division signal is ON, the signal represents that the division is set. The division signal is outputted from the print controller 400 to the post-processing controller 500.

At the time t0, by performing the operations shown in FIGS. 7 to 9, before starting a print processing, various setting information, such as the tab paper setting information set by the external apparatus 3 or the operation display unit 30, pages at which tab paper is inserted into a plurality of main recording media, an instruction for dividing printed matter having a plurality of main contents recording media into a plurality of groups and the like, and image data are stored as job data in the nonvolatile memory 130. Then, by referring to the job data and tab paper setting information, it is determined whether the post-processing mode D4 is set to a stapling operation or not, whether the function of the intersheet D5 is set or not, and whether the tab paper is inserted or not. Then, the insertion pointer is set to "1" and the output page D11, the paper feeding counter D12, and the unnecessary tab paper discharge counter D15 are initialized (set to "0") and the unnecessary tab paper discharge flag is set to "0". Because the final paper information is not set, the value "1" is added to the output page.

At the time t1, the individual image data stored in an image storage address of a page number corresponding to the output page is expanded in the page memory and printing page data of the page number corresponding to the output page is retained.

Then, the information for printing page data, which is previously set is returned to the initial status. In the retained print data, the final paper information is not set. In this job, a stapling operation, an intersheet function, and a tab paper insertion are set. The unnecessary tab paper discharge flag D14 is set to 0. The page number (D7*a*=2) of the specified page 1 shown by the insertion pointer D13 is not equal to the value of the paper feeding counter (D12=0). Thus, the value "1" is added to the value of the paper feeding counter D12. In the information for the printing page data, the stapling operation is set, the end of the stapling operation (division) is not specified, the tray 1 is set as a paper feeding tray, and it is specified that the image data exists.

Because the end of the stapling operation (division) is not specified and the value of the paper feeding counter (D12=1) is not equal to the number of already-read images (D10=5), a conveyance processing to the main contents recording medium at the first page is completed.

At the time t2, based on the first paper feeding signal from the printer controller 400, the information for the printing page data, which is previously set is returned to the initial status. In the retained print data, the final paper information is not set. In this job, the stapling operation, the intersheet function, and the tab paper insertion are set. The unnecessary tab paper discharge flag D14 is set to 0. The page number (D7*a*=2) of the specified page 1 shown by the insertion pointer D13 is not equal to the value of the paper feeding counter (D12=1). Thus, the value "1" is added to the value of the paper feeding counter D12. In the information for the printing page data, the stapling operation is set, the end of the stapling operation (division) is not specified, the tray 1 is set as a paper feeding tray, and it is specified that the image data exists.

Because the end of the stapling operation (division) is not specified and the value of the paper feeding counter (D12=2) is not equal to the number of already-read images (D10=5), the conveyance processing to the main contents recording medium at the second page is completed.

At the time t3, based on the first paper feeding signal from the printer controller 400, the information for printing page data, which is previously set is returned to the initial status. In the retained print data, the final paper information is not set. In this job, the stapling operation, the intersheet function, and the tab paper insertion are set. The unnecessary tab paper discharge flag D14 is set to 0. The page number (D7*a*=2) of the specified page 1 shown by the insertion pointer D13 is equal to the value of the paper feeding counter (D12=2). Thus, the value "1" is added to the value of the tab paper counter D16 and the value of the insertion pointer D13. In the information for the printing page data, the stapling operation is set, the end of the stapling operation (division) is not specified, the tray 2 is set as a paper feeding tray, and it is specified that the image data does not exist. Then, this processing in the tab paper insertion operation is completed.

From the time t1 to the time t4, in accordance with the first paper feeding signal, the main body recording medium stored in the tray 1 is conveyed to the resist roller 42*a*. In accordance with the second paper feeding signal, the main contents recording medium is conveyed from the resist roller 42*a* to the transfer device 43*a*. Then, the image writing signal PVV is ON in synchronization with the second paper feeding preparation signal. An image based on printing page data at the first page is formed on the main contents recording medium. The value "1" is added to the output page D11. Then, the main contents recording medium P1 on which the image of the first page is formed, is outputted to the post-processing apparatus 2.

At the time t4, in accordance with the first paper feeding signal from the printer controller 400, the information for the printing page data, which is previously set is returned to the initial status. In the retained print data, the final paper information is not set. In this job, the stapling operation, the intersheet function, and the tab paper insertion are set. The unnecessary tab paper discharge flag D14 is set to 0. The page number (D7*b*=4) of the specified page 2 shown by the insertion pointer D13 is not equal to the value of the paper feeding counter (D12=2). Thus, the value "1" is added to the value of the paper feeding counter D12. In the information for the printing page data, the stapling operation is set, the end of the stapling operation (division) is specified, the tray 1 is set as a paper feeding tray, and it is specified that the image data exists.

The end of the stapling operation (division) is specified. The value of the unnecessary tab paper discharge counter D15 is calculated as "2" by the formula (1). The value of the tab paper counter D16 is set to "0". The calculated value of the unnecessary tab paper discharge counter (D15=2) is not equal to "0" or the number of tab papers ("3"). Therefore, the unnecessary tab paper discharge flag D14 is set to "1" and a conveyance processing to the main contents recording medium at the third page is completed.

From the time t2 to the time t5, in accordance with the first paper feeding signal, the main body recording medium stored in the tray 1 is conveyed to the resist roller 42*a*. In accordance with the second paper feeding signal, the main contents recording medium is conveyed from the resist roller 42*a* to the transfer device 43*a*. Then, the image writing signal PVV is ON in synchronization with the second paper feeding preparation signal. An image based on printing page data at the second page is formed on the main contents recording medium. The value "1" is added to the output page D11. Then, the main contents recording medium P2 on which the image of the second page is formed, is outputted to the post-processing apparatus 2.

At the time t5, in accordance with the first paper feeding signal from the printer controller 400, the information for the printing page data, which is previously set is returned to the initial status. In the retained print data, the final paper information is not set. In this job, the stapling operation, the intersheet function, and the tab paper insertion are set. The unnecessary tab paper discharge flag D14 is set to 1. Thus, the value "1" is reduced from the unnecessary tab paper discharge counter D15. In the information for the printing page data, the tray 2 is set as a paper feeding tray, it is specified that the image data does not exist, it is specified that the paper is discharged from the unnecessary paper discharging tray and the division is not specified.

Because the value of the unnecessary tab paper discharge counter D15 is "1", this processing in the operation for discharging tab paper is completed.

From the time t3 to the time t6, in accordance with the first paper feeding signal, the tab paper Tb1 stored in the tray 2 is conveyed to the resist roller 42*a*, and in accordance with the second paper feeding signal, the tab paper Tb1 is conveyed from the resist roller 42*a* to the transfer device 43*a*. Then, the tab paper Tb1 is outputted to the post-processing apparatus 2 without forming an image.

At the time t6, in accordance with the first paper feeding signal from the printer controller 400, the information for the printing page data, which is previously set is returned to the initial status. In the retained print data, the final paper information is not set. In this job, the stapling operation, the intersheet function, and the tab paper insertion are set. The unnecessary tab paper discharge flag D14 is set to 1. Thus, the value "1" is reduced from the unnecessary tab paper discharge counter D15. In the information for the printing page data, the tray 2 is set as a paper feeding tray, it is specified that the image data does not exist, it is specified that the paper is discharged from the unnecessary paper discharging tray and the division is not specified.

Because the unnecessary tab paper discharge counter D15 is "0", the unnecessary tab paper discharge flag is set to "0". Because the value of the paper feeding counter (D12=3) is not equal to the value of the number of already-read images (D10=5), this processing in the operation for discharging tab paper is completed.

From the time t4 to the time t7, the substantially same processing as the processing performed from the time t2 to the time t5 are performed. Then, the image based on the printing page data at the third page is formed on the main contents recording medium. The value "1" is added to the output page D11. Then, the main contents recording medium P3 on which the image of the third page is formed, is outputted to the post-processing apparatus 2.

From the time t6 to the time t7, the main body recording medium P3 is outputted to the post-processing apparatus 2 and the division signal is ON. Thus, the stapling processing is carried out for the main contents recording media P1 to P3 outputted to the post-processing apparatus 2 from the time t0 to the time t7 and the inserted tab paper Tb1 to prepare a booklet. This booklet is discharged to the paper discharging tray T3.

At the time t7, the substantially same processing as that of the time t2 is performed and this processing to the main contents recording medium at the fourth page is completed.

At the times t5 to t8, in accordance with the first paper feeding signal, the tab paper Tb2 stored in the tray 2 is conveyed to the resist roller 42*a*. In accordance with the second paper feeding signal, the tab paper Tb2 is conveyed from the resist roller 42*a* to the transfer device 43*a*. Then, the tab paper Tb2 is outputted to the post-processing apparatus 2 without forming an image. The tab paper Tb2 outputted to the post-processing apparatus 2 is discharged to the unnecessary paper discharging tray T4.

At the time t8, the substantially same processing as that of the time t3 is performed and this processing in the operation for inserting tab paper is completed.

From the time t6 to the time t9, in accordance with the first paper feeding signal, the tab paper Tb3 stored in the tray 2 is conveyed to the resist roller 42*a*. In accordance with the second paper feeding signal, the tab paper Tb3 is conveyed from the resist roller 42*a* to the transfer device 43*a*. Then, the tab paper Tb3 is outputted to the post-processing apparatus 2 without forming an image. The tab paper Tb3 outputted to the post-processing apparatus 2 is discharged to the unnecessary paper discharging tray T4.

At the time t9, the substantially same processing as that of the time t4 is performed and the conveyance processing to the main contents recording medium at the fifth page is completed.

From the time t7 to the time t10, the substantially same processing as the processing performed from the time t2 to the time t5 are performed. Then, the main contents recording medium P2 on which an image of the fourth page is formed, is outputted to the post-processing apparatus 2.

At the time t10, the substantially same processing as that of the time t5 is performed and this processing in the operation for discharging tab paper is completed.

From the time t8 to the time t11, the substantially same processing as the processing performed from the time t3 to the time t6 are performed. Then, the tab paper Tb1 stored in the tray 2 is outputted to the post-processing apparatus 2 without forming an image.

At the time t11, the information for printing page data, which is previously set is returned to the initial status. In the retained print data, the final paper information is not set. In this job, the stapling operation, the intersheet function, and the tab paper insertion are set. The unnecessary tab paper discharge flag D14 is set to 1. Thus, the value "1" is reduced from the unnecessary tab paper discharge counter D15. In the information for the printing page data, the tray 2 is set as a paper feeding tray, it is specified that the image data does not exist, it is specified that the paper is discharged from the unnecessary paper discharging tray and the division is not specified.

Because the value of the unnecessary tab paper discharge counter D15 is "0", the value of the unnecessary tab paper discharge flag is set to "0". Because the value of the paper feeding counter (D12=5) is equal to the value of the number of already-read images (D10=5), the final paper information is set. This processing in the operation for discharging tab paper is completed.

From the time t9 to the time t12, the substantially same processing as processing performed from the time t4 to the time t7 are performed. Then, the main contents recording medium P5 on which the image of the fifth page is formed, is outputted to the post-processing apparatus 2.

From the time t11 to the time t12, the main body recording medium P5 is outputted to the post-processing apparatus 2 and the division signal is ON. Thus, the stapling processing is carried out for the main contents recording media P4 and P5 outputted to the post-processing apparatus 2 from the time t9 to the time t12 and the inserted tab paper Tb1 to prepare a booklet. This booklet is discharged to the paper discharging tray T3.

At the time t12, the information for the printing page data, which is previously set is returned to the initial status. Because the final paper information is set, this processing is completed.

From the time t10 to the time t13, the same processing as the processing performed from the time t5 to the time t8 are performed and the tab paper Tb2 is discharged to the unnecessary paper discharging tray T4. From the time t11 to the time t14, the same processing as the processing performed from the time t6 to the time t9 are performed and the tab paper Tb3 is discharged to the unnecessary paper discharging tray T4.

As described above, according to this embodiment, in a processing for inserting tab paper into printed matter divided into a plurality of groups, the top tab paper inserted into each of the plurality of group can be set to tab paper arranged at the top of one set. It is possible to insert tab paper into each group sequentially from the top. Thus, the order of tab papers inserted into each group can be accurately secured. Furthermore, a user does not have to divide printed matter into each group in advance in order to secure the order of tab papers to be inserted into each group. Therefore, it is possible to improve the convenience to the user.

Furthermore, when there is unnecessary tab paper, the unnecessary tab paper can be discharged out of the image forming system A. Therefore, it is possible to prevent a situation that the unnecessary tab paper is mixed in a group into which the tab paper is inserted.

Furthermore, the printed matter can be divided into each group at a position at which a stapling processing is ended. Thus, the printed matter can be divided into a plurality of booklets. Further, a plurality of booklets in which tab paper is sequentially inserted from the top can be prepared. Because tab paper or a color sheet can be used as a special sheet to be inserted into a booklet, it is possible to provide an easily viewable booklet.

It is noted that, although in this embodiment an image forming system comprising an image forming apparatus and a post-processing apparatus is explained, the present invention also can be applied to an image forming apparatus comprising a post-processing function realized by a post-processing apparatus. In this case, the same effect can be obtained.

The present invention is not limited to the contents of the above embodiments and can be appropriately changed in a scope within the gist of the present invention.

The present U.S. patent application claims the priority of Japanese Patent Application No. 2006-88049 filed on Mar. 28, 2006, according to the Paris Convention, and the above Japanese Patent Application is the basis for correcting mistranslation of the present U.S. patent application.

What is claimed is:

1. An image forming system comprising:

an image forming unit that forms images based on a plurality of document pages on a plurality of recording media to form a printed matter;

a special sheet feeding unit that stores a special sheet group constituting one set in which a plurality of different types of special sheets are arranged in a predetermined order;

a division setting input that accepts an instruction for dividing one printed bundle into a plurality of groups so that the one printed bundle is composed of recording media of the plurality of groups;

a special sheet setting input unit that accepts the number of the special sheets constituting the one set and a page of which the special sheet is inserted into the plurality of groups, and is configured to insert the special sheet into the recording media of the plurality of groups after the one printed bundle is divided into the plurality of groups; and a control unit that sets a special sheet inserted into a first place in each of the plurality of groups to a special sheet arranged at a top of the one set when the special sheet setting input unit accepts the page of which the special sheet is inserted and when the division setting input unit accepts the instruction for dividing the one printed bundle into the plurality of groups.

2. The image forming system of claim 1, wherein:

the control unit discharges an unnecessary special sheet out of the image forming system when the unnecessary special sheet exists, so as to set the special sheet inserted into the first place in each of the plurality of groups to the special sheet arranged at the top of the one set.

3. The image forming system of claim 2, wherein:

the control unit discharges a special sheet out of the image forming system as the unnecessary special sheet for each group, the discharged special sheet being included in a same set as a set of special sheets, which includes a special sheet finally inserted into each group.

4. The image forming system of claim 2, wherein:

when the number of the unnecessary special sheets is not 0 or is not the number of special sheets constituting the special sheet group, the control unit discharges the unnecessary special sheet out of the image forming system for each group.

5. The image forming system of claim 2, wherein:

when the number of the special sheets constituting the one set is "n" and the number of special sheets inserted into the group is "m", the control unit calculates a value X by a following formula (1) as the number of the unnecessary special sheets and discharges X special sheets out of the image forming system $$X=n-(\text{remainder of } m/n) \qquad \text{formula (1).}$$

6. The image forming system of claim 2, wherein:

the control unit discharges the unnecessary special sheet out of the image forming system after inserting a final special sheet into a first group and before inserting a first special sheet into a second group following the first group.

7. The image forming system of claim 1, wherein:

the special sheets constituting the special sheet group are tab paper or color sheets.

8. The image forming system of claim 1, wherein:

the instruction for dividing the printed bundle into the plurality of groups is an instruction showing a position at which a stapling processing for binding the plurality of recording media on which the images of the plurality of document pages are formed is completed.

9. The image forming system of claim 1, further comprising a post-processing unit that carries out a post-processing for each of the plurality of groups.

10. An image forming system comprising:

an image forming unit that forms images based on a plurality of document pages on a plurality of recording media to form a printed matter;

a special sheet feeding unit that stores a special sheet group constituting one set in which a plurality of different types of special sheets are arranged in a predetermined order;

a division setting input unit that accepts an instruction for dividing one printed bundle into a plurality of groups so that the one printed bundle is composed of recording media of the plurality of groups;

a special sheet setting input unit that sets the number of the special sheets constituting the one set and a position at which the special sheet is inserted into each of the plurality of groups, and is configured to insert the special sheet into the recording media of the plurality of groups after the one printed bundle is divided into the plurality of groups; and a conveyance control unit that, after the recording media form the one printed bundle, inserts the special sheet at the position set by the special sheet setting input unit, and which discharges an unnecessary special sheet so as to set a special sheet first inserted into each of the plurality of groups divided by the division setting input unit, to a special sheet arranged at a top of the one set.

11. The image forming system of claim 10, wherein:

the instruction for dividing the printed bundle into a plurality of groups, is an instruction for showing a position at which a stapling processing for binding the plurality of recording media on which the images of the plurality of document pages are formed is completed.

* * * * *